US011235579B2

(12) United States Patent
Nukui et al.

(10) Patent No.: US 11,235,579 B2
(45) Date of Patent: Feb. 1, 2022

(54) PRINTER SYSTEM HAVING A COVER AND RESERVOIR CONNECTABLE TO A TANK

(71) Applicant: BROTHER KOGYO KABUSHIKI KAISHA, Nagoya (JP)

(72) Inventors: Kosuke Nukui, Nagoya (JP); Hiroaki Takahashi, Nagoya (JP); Akihito Ono, Nagoya (JP); Takahiro Miyao, Nisshin (JP); Akinari Ishibe, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/137,510

(22) Filed: Dec. 30, 2020

(65) Prior Publication Data

US 2021/0237457 A1 Aug. 5, 2021

Related U.S. Application Data

(63) Continuation of application No. 16/740,963, filed on Jan. 13, 2020, now Pat. No. 10,899,133.

(30) Foreign Application Priority Data

Jan. 17, 2019 (JP) ..... JP2019-005741

(51) Int. Cl.
*B41J 2/175* (2006.01)
*B65D 88/34* (2006.01)

(52) U.S. Cl.
CPC ..... *B41J 2/17513* (2013.01); *B65D 88/34* (2013.01); *B41J 2/1752* (2013.01); *B41J 2/17509* (2013.01); *B41J 2/17553* (2013.01); *B41J 2002/17576* (2013.01)

(58) Field of Classification Search
CPC ..... B41J 2/17513; B41J 2002/17576; B41J 2/1752; B41J 2/17509; B41J 2/17533; B41J 2/1753; B41J 2/17546; B41J 2/17566; B41J 29/13; B41J 2/175; B65D 88/34
See application file for complete search history.

(56) References Cited

U.S. PATENT DOCUMENTS

2016/0288519 A1 10/2016 Danzuka et al.
2017/0120617 A1* 5/2017 Matsumura ..... B41J 2/17596
2018/0244054 A1 8/2018 Kanaya et al.

FOREIGN PATENT DOCUMENTS

JP 2016-190334 A 11/2016
JP 2016-196109 A 11/2016
JP 2017-081121 A 5/2017

* cited by examiner

*Primary Examiner* — Bradley W Thies
(74) *Attorney, Agent, or Firm* — Merchant & Gould P.C.

(57) ABSTRACT

A system includes: a housing; a cover that is supported by the housing to be movable between a covering position and an opened position; a tank; a reservoir; and a liquid discharging head that is disposed inside the housing and discharges liquid supplied from the tank, wherein the reservoir includes a liquid passage hole; the tank includes a passage tube that extends upward from the tank and is connectable to the liquid passage hole of the reservoir, the cover includes: a first wall that is positioned above the housing at the covering position, and a second wall that extends downward from an edge of the first wall, and when the cover is positioned at the covering position and the reservoir is connected to the tank, an upper end of the reservoir is positioned above a lower end of the second wall.

10 Claims, 13 Drawing Sheets

PRINTER SYSTEM HAVING A COVER AND RESERVOIR CONNECTABLE TO A TANK

CROSS-REFERENCE TO RELATED APPLICATION

This application is a continuation of U.S. patent application Ser. No. 16/740,963, filed Jan. 13, 2020, which claims priority from Japanese Patent Application No. 2019-005741 filed on Jan. 17, 2019. The entire subject matter of these applications is incorporated herein by reference.

TECHNICAL FIELD

This disclosure relates to a system including: a reservoir that stores liquid; and a tank to which the reservoir is connectable.

BACKGROUND ART

A system including: a reservoir that stores liquid; and a tank to which the reservoir is connectable is known in the related art. For example, a background art discloses a system including: a reservoir that stores ink; and an ink-jet recording apparatus that includes a tank to which the reservoir is connectable.

The ink-jet recording apparatus disclosed in the background art include four tanks, and the reservoir is connected to each of the tanks. As a result, liquid (ink) is injected from the reservoir to the tank. In a case where a user operates an image recording apparatus (for example, in a case where the user operates a touch panel of the image recording apparatus or sets a sheet to the image recording apparatus), three tanks among the four tanks are disposed on the right of a discharge tray when seen from the user. One tank among the four tanks is disposed on the left of the discharge tray.

SUMMARY

In order to increase the volume of liquid that can be stored in a reservoir, for example, a method of increasing a size of the reservoir in a left-right direction may be adopted. In addition, for example, a method of increasing a size of the reservoir in a front-rear direction (direction perpendicular to the left-right direction and an up-down direction) may be adopted.

However, in the method of increasing the size of the reservoir in the horizontal direction such as the left-right direction or the front-rear direction, an installation area of a housing increases.

This disclosure provide a system in which a volume of a reservoir can be increased without increasing an installation area of a housing.

A system according to this disclosure includes: a housing; a cover that is supported by the housing to be movable between a covering position, where an upper end of the housing is covered, and an opened position, where the upper end of the housing is opened; a tank that is disposed inside the housing and is configured to store liquid; a reservoir that is connectable to the tank and is configured to store liquid; and a liquid discharging head that is disposed inside the housing and configured to discharge liquid supplied from the tank. The reservoir includes a liquid passage hole through which the stored liquid is flowable to an outside of the reservoir. The tank includes a passage tube that extends upward from the tank and is connectable to the liquid passage hole of the reservoir, the cover includes: a first wall that is positioned above the housing at the covering position, and a second wall that extends downward from an edge of the first wall. When the cover is positioned at the covering position and the reservoir is connected to the tank, an upper end of the reservoir is positioned above a lower end of the second wall.

According to this configuration, the reservoir extends up to a position above the lower end of the second wall of the cover. That is, in the reservoir having the above-described configuration, the length in the up-down direction can be set to be longer than that of the reservoir that extends only up to a position below the lower end of the second wall of the cover. As a result, the volume of the reservoir can be increased without increasing the installation area of the housing.

According this disclosure, the volume of the reservoir can be increased without increasing the installation area of the housing.

BRIEF DESCRIPTION OF THE DRAWINGS

The foregoing and additional features and characteristics of this disclosure will become more apparent from the following detailed descriptions considered with the reference to the accompanying drawings, wherein.

DESCRIPTION OF EMBODIMENTS

Hereinafter, an embodiment of this disclosure will be described with reference to the accompanying drawings. The following embodiment is merely a specific example of this disclosure, and it is needless to say that the embodiment can be appropriately changed within a range where the scope of this disclosure does not change.

[Overall Configuration of Multifunctional Peripheral 10]

Figure 1:
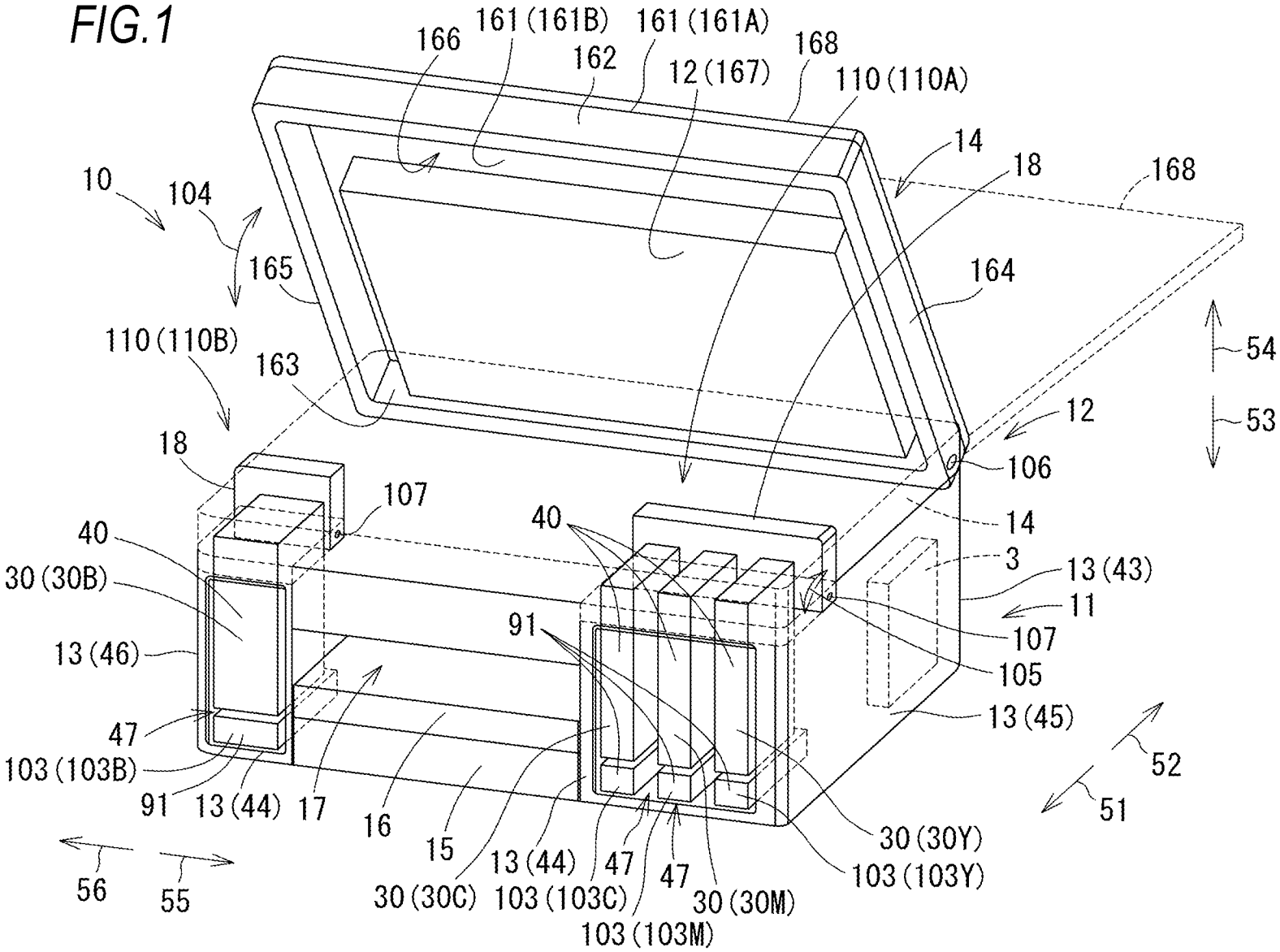
FIG. 1 is a perspective view illustrating a multifunctional peripheral 10 on which an ink cartridge 30 is mounted.

As illustrated in FIG. 1, a multifunctional peripheral 10 has a substantially rectangular shape as a whole.

When a posture in which the multifunctional peripheral 10 is provided on a horizontal surface to be usable is set as a reference, a gravity direction is defined as a downward direction 53, and a direction opposite to the downward direction 53 is defined as an upward direction 54. Assuming that a wall where an opening 17 of the multifunctional peripheral 10 is provided is a front wall 44, a front direction 51 and a rear direction 52 that is opposite to the front direction 51 are defined. In addition, when the multifunctional peripheral 10 is seen from the front, a right direction 55 and a left direction 56 are defined. The upward direction 54 and the downward direction 53, the front direction 51 and the rear direction 52, and the right direction 55 and the left direction 56 are perpendicular to each other. The front direction 51 and the rear direction 52 are defined as a front-rear direction (an example of the front-rear direction). The upward direction 54 and the downward direction 53 are defined as an up-down direction (an example of the height direction). The right direction 55 and the left direction 56 are defined as a left-right direction (an example of the width direction).

The multifunctional peripheral 10 includes a printer 11 and a scanner 12. The scanner 12 is positioned above the printer 11. A system is formed with the multifunctional peripheral 10 and an ink cartridge 30 described below.

The printer 11 is an image recording apparatus, for example, an ink-jet printer that records an image by discharging ink droplets to a sheet 2 (refer to FIG. 2) based on an ink-jet recording method. The scanner 12 is a flatbed scanner.

The printer 11 is a lower housing 13 (an example of the housing) of the multifunctional peripheral 10. The scanner 12 is a cover 14 of the multifunctional peripheral 10.

The lower housing 13 has a box shape having an upper end at least a part of which is opened. The lower housing 13 includes the front wall 44, a rear wall 43, a right side wall 45, and a left side wall 46. The front wall 44 is a wall spreading in the up-down direction and the left-right direction and has the opening 17. The rear wall 43 is a wall spreading in the up-down direction and the left-right direction and faces the front wall 44 in the front-rear direction. The right side wall 45 is a wall spreading in the up-down direction and the front-rear direction and connects a right end of the front wall 44 and a right end of the rear wall 43 to each other. The left side wall 46 is a wall spreading in the up-down direction and the front-rear direction and connects a left end of the front wall 44 and a left end of the rear wall 43 to each other.

The cover 14 is positioned above the lower housing 13. The cover 14 is connected to the lower housing 13 in a rear end portion of the multifunctional peripheral 10. The cover 14 is supported by the lower housing 13. The cover 14 is rotatable about an axis 106 in a direction indicated by an arrow 104, the axis 106 being positioned at a connection portion to the lower housing 13. As a result, the cover 14 is rotatable to a covering position indicated by a broken line in FIG. 1 and an opened position indicated by a solid line in FIG. 1. The cover 14 at the covering position covers an upper end of the lower housing 13. The cover 14 at the opened position opens the upper end of the lower housing 13.

The cover 14 has a box shape with an open bottom. The cover 14 includes a top wall 161 (an example of a first wall), a front side wall 162 (an example of a second wall), a rear side wall 163, a right side wall 164, a left side wall 165, and the scanner 12.

The top wall 161 is a wall spreading in the front-rear direction and the left-right direction when the cover 14 is positioned at the covering position. The top wall 161 is positioned above the lower housing 13 and covers the lower housing 13 from above when the cover 14 is positioned at the covering position.

The front side wall 162, the rear side wall 163, the right side wall 164, and the left side wall 165 extend downward from edges of the top wall 161. In the embodiment, the lengths of the front side wall 162, the rear side wall 163, the right side wall 164, and the left side wall 165 in the up-down direction are the same.

The front side wall 162 extends downward from a front end portion of the top wall 161. The front side wall 162 is a wall facing the front (the front side in the front-rear direction). The rear side wall 163 extends downward from a rear end portion of the top wall 161. The rear side wall 163 is a wall facing the rear (the rear side in the front-rear direction). The front side wall 162 and the rear side wall 163 face each other in the front-rear direction.

The right side wall 164 extends downward from a right end portion of the top wall 161. The left side wall 165 extends downward from a left end portion of the top wall 161. The right side wall 164 and the left side wall 165 face each other in the left-right direction.

A front end of the right side wall 164 is connected to a right end of the front side wall 162. A rear end of the right side wall 164 is connected to a right end of the rear side wall 163. A front end of the left side wall 165 is connected to a left end of the front side wall 162. A rear end of the left side wall 165 is connected to a left end of the rear side wall 163.

When the cover 14 is positioned at the covering position, the front side wall 162 is positioned above the front wall 44 of the lower housing 13, the rear side wall 163 is positioned above the rear wall 43 of the lower housing 13, the right side wall 164 is positioned above the right side wall 45 of the lower housing 13, and the left side wall 165 is positioned above the left side wall 46 of the lower housing 13.

An internal space 166 of the cover 14 is formed with the top wall 161, the front side wall 162, the rear side wall 163, the right side wall 164, and the left side wall 165.

The shape of the cover 14 is not limited to the shape illustrated in FIG. 1. For example, the front side wall 162, the rear side wall 163, the right side wall 164, and the left side wall 165 are not necessarily connected to each other. In addition, for example, the cover 14 may include the top wall 161, the front side wall 162, and the rear side wall 163 without including the right side wall 164 and the left side wall 165. In this case, the internal space 166 is formed with the top wall 161, the front side wall 162, and the rear side wall 163.

The scanner 12 includes: a scanner housing 167 that is formed to be integrated with the top wall 161 and is attached to the top wall 161; and a scanner cover 168.

The scanner housing 167 protrudes downward from the top wall 161, and occupies a part of the internal space 166. When the cover 14 is positioned at the covering position and the multifunctional peripheral 10 is seen from above, the scanner housing 167 does not overlap a mounting portion 110 described below. In the scanner housing 167, a platen glass (not illustrated) on which a document (an example of the sheet) is set, an image sensor (not illustrated) that reads an image recorded on the document set on the platen glass, and the like are disposed. The platen glass forms at least a part of an upper surface 161A of the top wall 161 (a back surface of a lower surface 161B of the top wall 161 forming an upper end of the internal space 166). The document is set on the upper surface 161A of the top wall 161. That is, the upper surface 161A of the top wall 161 is a document reading surface.

The scanner cover 168 is positioned above the scanner housing 167. In an end portion of the cover 14 (in the embodiment, the end portion is the rear end portion of the cover 14 but may be the right end portion or the like), the scanner cover 168 is rotatably supported by at least one of the top wall 161, the rear side wall 163, the right side wall 164, and the left side wall 165. The scanner cover 168 is rotatable to the covering position indicated by the broken line in FIG. 1 and the opened position indicated by the solid line in FIG. 1. The scanner cover 168 at the covering position covers the upper surface 161A of the top wall 161 (when a document is set on the upper surface 161A, the upper surface 161A and the document). The scanner cover 168 at the opened position opens the upper surface 161A of the top wall 161.

Figure 2:
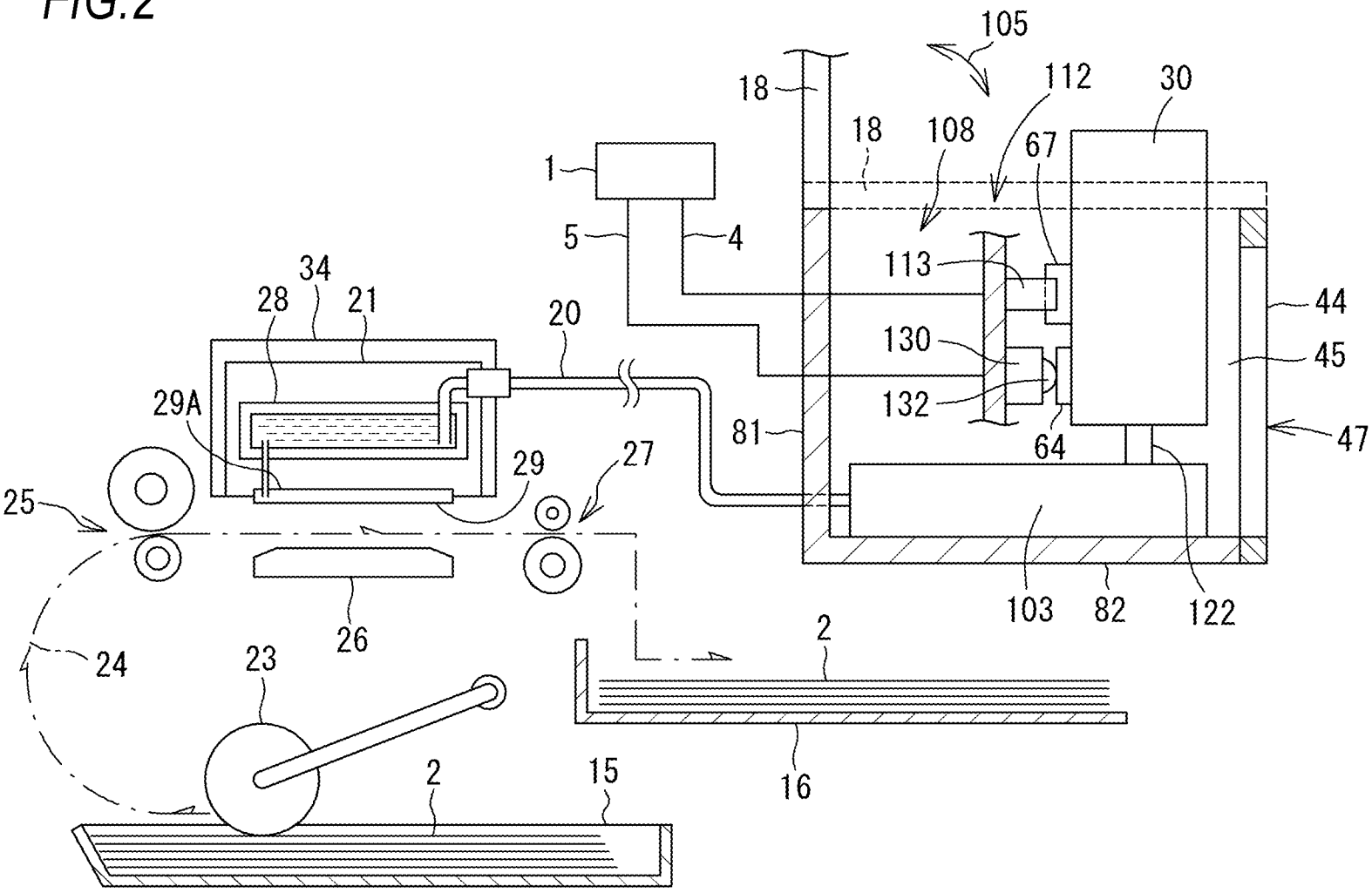
FIG. 2 is a longitudinal sectional view schematically illustrating an internal structure of the multifunctional peripheral 10.

As illustrated in FIG. 2, the multifunctional peripheral 10 includes a recording head 21 (an example of the liquid discharging head), the mounting portion 110, and an ink tube 20. In the mounting portion 110, at least one tank 103 that can store ink is disposed. The ink cartridge 30 is mounted on the mounting portion 110. In the ink cartridge 30, ink (an example of the liquid) that is supplied from the recording head 21 is stored. The ink cartridge 30 mounted on the mounting portion 110 is connected to the tank 103. The ink tube 20 is connected to the recording head 21 and at least one tank 103. An opening 112 is formed in an upper end of the mounting portion 110.

Figure 5:
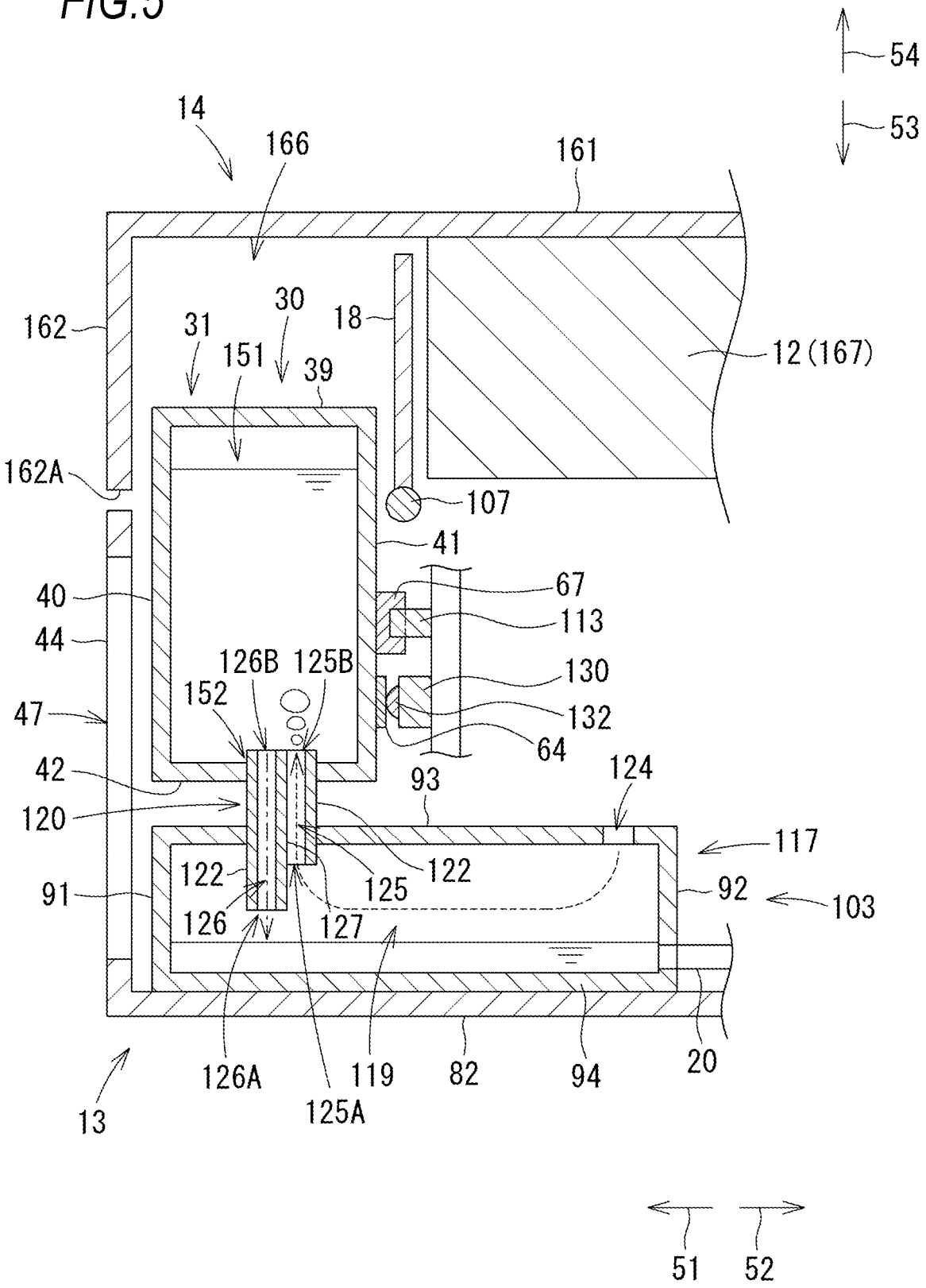
FIG. 5 is a longitudinal sectional view illustrating the periphery of the tank 103 in a mounted state.

The ink cartridge 30 is inserted into and mounted on the mounting portion 110 in a direction from the bottom to the top through the opening 112. The ink cartridge 30 is removed from the mounting portion 110 in a direction from the bottom to the top through the opening 112. FIGS. 1, 2, and 5 illustrated a mounted state that is a state where the mounting of the ink cartridge 30 on the mounting portion 110 is completed.

As illustrated in FIG. 2, in the mounted state, the ink cartridge 30 and the recording head 21 are connected to each other through the tank 103 and the ink tube 20. The recording head 21 is disposed inside the lower housing 13. The recording head 21 includes a sub-tank 28. The sub-tank 28 temporarily stores ink supplied through the ink tube 20. The recording head 21 discharges ink supplied from the sub-tank 28 through a nozzle 29 using an ink-jet recording method. Specifically, a drive voltage is selectively applied from a head control board (not illustrated) provided in the recording head 21 to a piezoelectric element 29A corresponding to each of nozzles 29. As a result, ink is discharged from the nozzle 29. The recording head 21 is mounted on a carriage 34. The carriage 34 is supported by a frame (not illustrated) of the lower housing 13 to be movable along the left-right direction.

The multifunctional peripheral 10 includes a feed tray 15, a feed roller 23, a conveying roller pair 25, a platen 26, a discharge roller pair 27, and a discharge tray 16. The sheet 2 that is fed from the feed tray 15 to a conveying path 24 by the feed roller 23 is conveyed by the conveying roller pair 25 in a conveying direction 19. The conveying direction 19 is indicated by a chain line arrow in FIG. 2. When the sheet 2 is conveyed to the platen 26 by the conveying roller pair 25, the carriage 34 moves along the left-right direction. At this time, the recording head 21 discharges ink to the sheet that is passing through the platen 26. As a result, an image is recorded on the sheet 2. The sheet 2 having passed the platen 26 is supported by the discharge roller pair 27 in the discharge tray 16 provided on the most downstream side of the conveying path 24. The sheet 2 supported by the discharge tray 16 is discharged through the opening 17.

Figure 3:
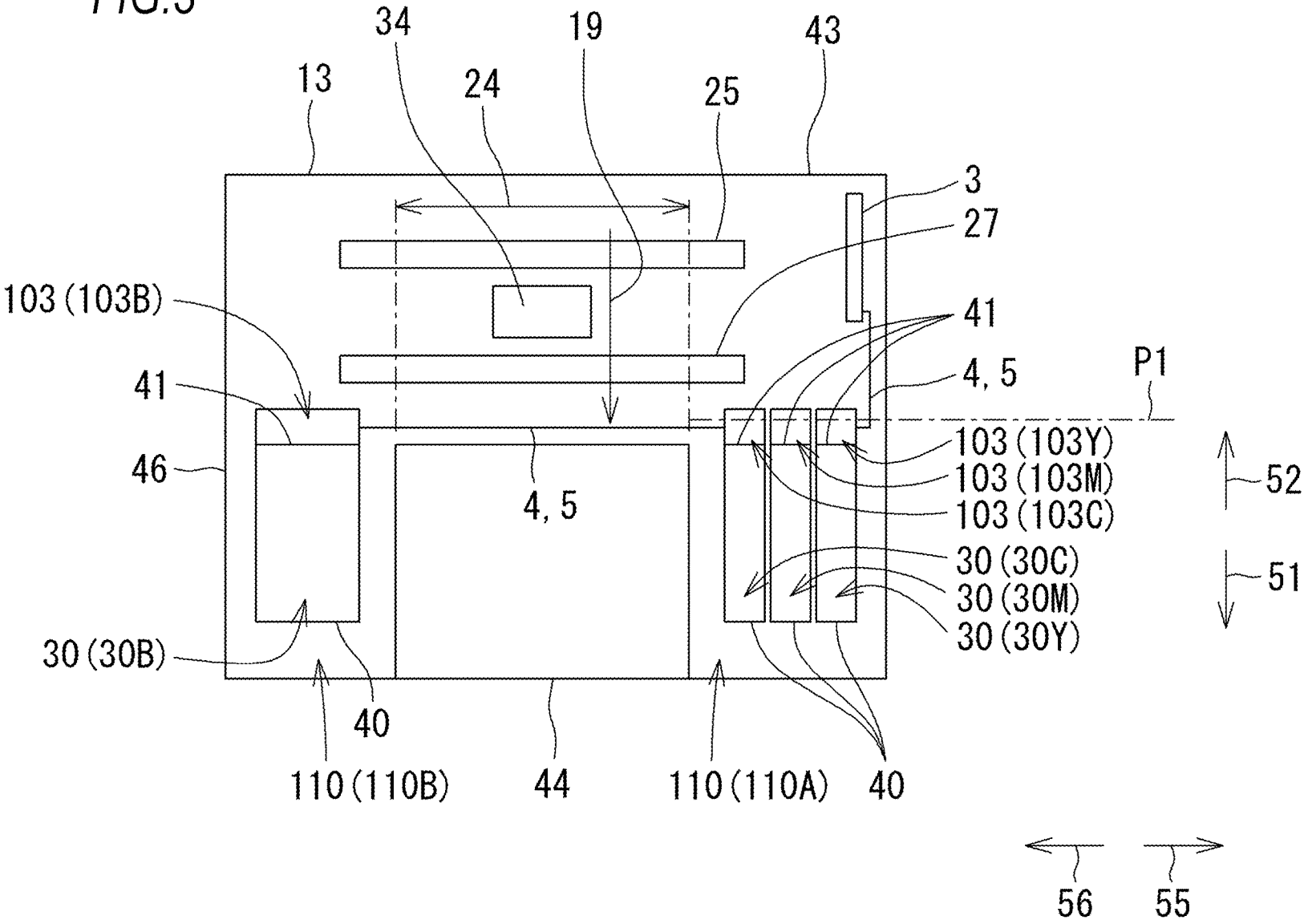
FIG. 3 is a plan view illustrating a lower housing 13.

As illustrated in FIG. 3, the conveying path 24 is conveyed in the front-rear direction from the conveying roller pair 25 to the discharge roller pair 27 through a gap between the recording head 21 and the platen 26. The conveying path 24 is formed substantially at a center portion of the lower housing 13 in the left-right direction. The carriage 34 is movable to a region where the conveying path 24 is formed (a region between two chain lines in FIG. 3), a region on the right of the conveying path 24, and a region on the left of the conveying path 24.

[Mounting Portion 110]

As illustrated in FIG. 1, the mounting portion 110 includes: a mounting portion 110A that is disposed in a right end portion of the lower housing 13; and a mounting portion 110B that is disposed in a left end portion of the lower housing 13. As illustrated in FIG. 3, the mounting portion 110A is positioned on right of the conveying path 24. The mounting portion 110B is positioned on the left of the conveying path 24. The mounting portion 110A and the mounting portion 110B have substantially the same configuration. Therefore, hereinbelow, the configuration of the mounting portion 110A will be described. The configuration of the mounting portion 110B will not be described in principle and will be optionally described.

As illustrated in FIG. 2, the mounting portion 110A includes a holder 101, the tank 103, an optical sensor 113, and a connector 130. The mounting portion 110A does not necessarily include the optical sensor 113.

[Holder 101]

As illustrated in FIG. 2, the holder 101 forms a housing of the mounting portion 110A. The holder 101 includes an inner wall 81 and a bottom wall 82. The inner wall 81 is positioned in the rear of the front wall 44 of the lower housing 13 and faces the front wall 44 in the front-rear direction. The bottom wall 82 extends forward from a lower end portion of the inner wall 81. An internal space 108 of the holder 101 is formed with the inner wall 81, the bottom wall 82, the front wall 44 of the lower housing 13, and the right side wall 45 of the lower housing 13. The right side wall 45 extends rearward from the right end portion of the front wall 44 and forms the right end of the lower housing 13.

In the case of the mounting portion 110B, the internal space 108 of the holder 101 is formed with the inner wall 81, the bottom wall 82, the front wall 44 of the lower housing 13, and the left side wall 46 of the lower housing 13. The left side wall 46 extends rearward from the left end portion of the front wall 44 and forms the left end of the lower housing 13.

As illustrated in FIG. 1, in the right end portion and the left end portion of the front wall 44, an opening 47 (an example of the light transmitting plate) is formed.

As illustrated in FIG. 2, an upper end of the holder 101 facing the bottom wall 82 in the up-down direction is the opening 112 through which the internal space 108 of the holder 101 communicates with the outside of the holder 101.

As illustrated in FIGS. 1 and 2, a sub-cover 18 is provided in the vicinity of the opening 112 of the holder 101. The sub-cover 18 is rotatably supported by an upper end portion of the inner wall 81. When the cover 14 is positioned at the opened position, the sub-cover 18 is movable about an axis 107 in a direction indicated by an arrow 105, the axis 107 being positioned at a connection portion to the inner wall 81. As a result, the sub-cover 18 is rotatable to the covering position indicated by the broken line in FIGS. 1 and 2 where the opening 112 is covered and the opened position indicated by the solid line in FIGS. 1 and 2 where the opening 112 is exposed to the outside.

As illustrated in FIGS. 1 and 2, when the ink cartridge 30 is connected to the tank 103, the sub-cover 18 is positioned at the opened position. At this time, the movement of the sub-cover 18 to the covering position is inhibited by the ink cartridge 30 (refer to FIG. 5). On the other hand, when the ink cartridge 30 is not connected to the tank 103, the sub-cover 18 is rotatable to the covering position (refer to FIG. 6). When the cover 14 is positioned at the opened position, the sub-cover 18 is rotatable. When the cover 14 is positioned at the opened position, the sub-cover 18 is positioned at the covering position and is covered by the cover 14 from above. The multifunctional peripheral 10 does not necessarily include the sub-cover 18.

The internal space 108 of the holder 101 is divided into three chambers arranged in the left-right direction by a partition wall (not illustrated). The tank 103, the optical sensor 113, and the connector 130 may be disposed in the divided chambers of the internal space 108, respectively. The internal space 108 does not necessarily include the partition wall. In this case, all of the tank 103, the optical sensor 113, and the connector 130 are disposed in the internal space 108 as one chamber.

In the embodiment, one ink cartridge 30 is mounted on the mounting portion 110B. Therefore, the internal space 108 of the holder 101 of the mounting portion 110B is not divided into a plurality of chambers (is formed as one chamber).

In the embodiment, in each of the three chambers of the mounting portion 110A, the tank 103 and the optical sensor 113 are disposed, and the connector 130 is not disposed. On the other hand, the tank 103, the optical sensor 113, and the connector 130 are disposed in one chamber of the mounting portion 110B.

The number of chambers in the internal space 108 of the holder 101 of the mounting portions 110A and 110B and the numbers of the tanks 103, the optical sensors 113, and the connectors 130 disposed in each of the chambers are not limited to the above-described numbers.

[Tank 103]

As illustrated in FIG. 2, the tank 103 is positioned below the internal space 108 of the holder 101. The tank 103 is supported in the bottom wall 82.

As described above, the internal space 108 of the holder 101 of the mounting portion 110A is divided into three chambers arranged in the left-right direction. That is, as illustrated in FIG. 3, in the internal space 108 of the holder 101 of the mounting portion 110A, the three tanks 103 are disposed in parallel along the left-right direction. When a plurality of tanks 103 are disposed in the mounting portion 110B, the tanks 103 may also be disposed in parallel along the left-right direction.

Figure 4A:
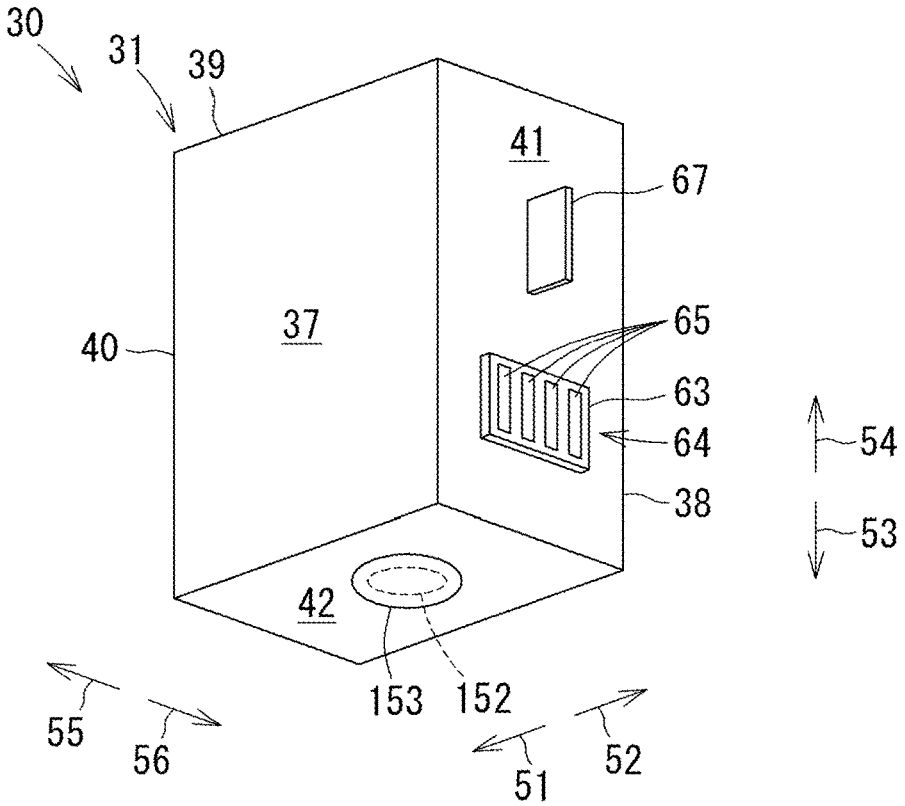
FIG. 4A is a perspective view illustrating the ink cartridge 30.
Figure 4B:
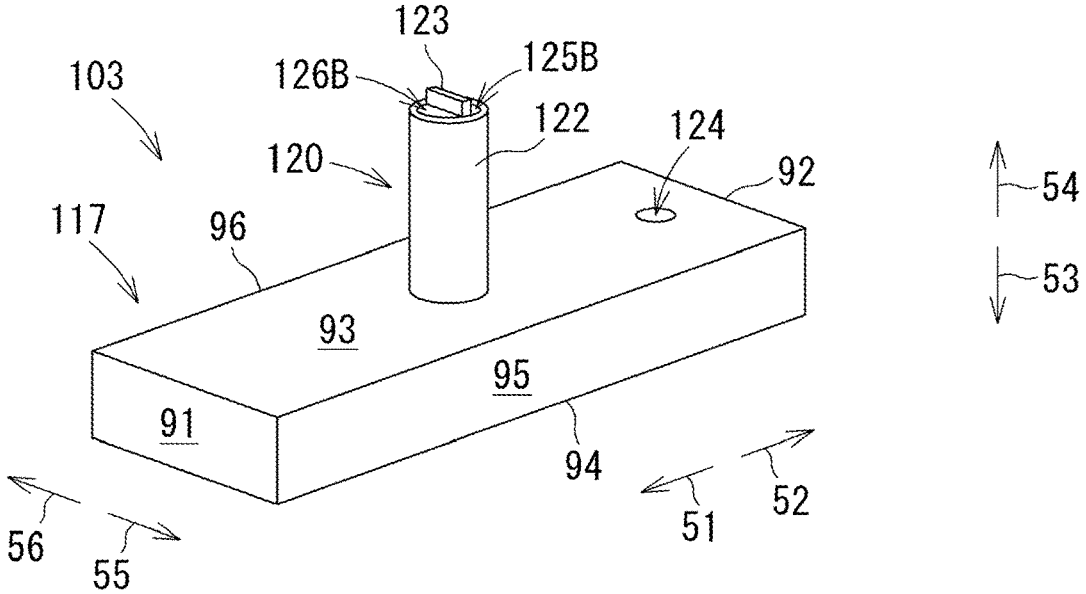
FIG. 4B is a perspective view illustrating a tank 103.

As illustrated in FIG. 4B, the tank 103 includes a housing 117 having a substantially rectangular shape.

The housing 117 includes a front wall 91, a rear wall 92, an upper wall 93, a lower wall 94, a right side wall 95, and a left side wall 96. The front wall 91, the right side wall 95, and the left side wall 96 are examples of the first wall. The front wall 91 and the rear wall 92 are separated from each other in the front-rear direction. The upper wall 93 is positioned between the front wall 91 and the rear wall 92 and extends from an upper end of the front wall 91 to an upper end of the rear wall 92. The lower wall 94 is positioned between the front wall 91 and the rear wall 92 and extends from a lower end of the front wall 91 to a lower end of the rear wall 92. The upper wall 93 and the lower wall 94 connect the front wall 91 and the rear wall 92 to each other. The right side wall 95 is positioned between the front wall 91 and the rear wall 92 and extends from a right end of the front wall 91 to a right end of the rear wall 92. The left side wall 96 is positioned between the front wall 91 and the rear wall 92 and extends from a left end of the front wall 91 to a left end of the rear wall 92. The right side wall 95 and the left side wall 96 connect the front wall 91 and the rear wall 92 to each other. The upper wall 93 and the lower wall 94 are separated from each other in the up-down direction. The right side wall 95 and the left side wall 96 are separated from each other in the left-right direction. The periphery of the right side wall 95 and the left side wall 96 are connected to the front wall 91, the rear wall 92, the upper wall 93, and the lower wall 94.

As illustrated in FIG. 5, the housing 117 includes an internal space 119. The internal space 119 is formed with the front wall 91, the rear wall 92, the upper wall 93, the lower wall 94, the right side wall 95, and the left side wall 96. In the internal space 119, ink can be stored.

In the embodiment, as illustrated in FIG. 1, in the three chambers of the internal space 108 of the holder 101 of the mounting portion 110A, the tank 103 that stores cyan ink (hereinafter, referred to as "tank 103C"), the tank 103 that stores magenta ink (hereinafter, referred to as "tank 103M"), and the tank 103 that stores yellow ink (hereinafter, referred to as "tank 103Y") are disposed in order from the left chamber. In one chamber of the internal space 108 of the holder 101 of the mounting portion 110B, the tank 103 that stores black ink (hereinafter, referred to as "tank 103B") is disposed. Hereinafter, the tanks 103C, 103M, 103Y, and 103B will also be collectively referred to as the tank 103. In addition, in the embodiment, all the tanks 103 store dye ink.

The color of ink stored in each of the tanks 103 is not limited to the above-described color. In addition, the material of ink stored in each of the tanks 103 is not limited to the dye. For example, the tank 103 disposed in one chamber of the internal space 108 of the holder 101 of the mounting portion 110B may store ink having a specific gravity (a second specific gravity) that is higher than the specific gravity (a first specific gravity) of ink stored in the tanks 103 disposed in the three chambers of the internal space 108 of the holder 101 of the mounting portion 110A. Examples of the ink having the second specific gravity include white ink and pigment ink. Examples of the ink having the first specific gravity include cyan, magenta, and yellow inks and dye ink.

It is needless to say that the color or material of the ink stored in the tank 103 disposed in each of the chambers is not limited to that of the above-described example and can be appropriately set.

The housing 117 has translucency such that the ink stored in the internal space 119 can be seen from the outside.

As illustrated in FIG. 1, the front wall 91 of the housing 117 faces the opening 47 in the front-rear direction, the opening 47 being formed in the front wall 44 of the lower housing 13. As a result, when the lower housing 13 is seen from the front, the front wall 91 can be seen through the opening 47. The front wall 91 has translucency. Therefore, when the lower housing 13 is seen from the front, the ink stored in the internal space 119 can be seen through the opening 47 and the front wall 91. In the embodiment, the inks stored in the tanks 103C, 103M, and 103Y can be seen through the opening 47 formed in the right end portion of the front wall 44 and the front wall 91, and the ink stored in the tank 103B can be seen through the opening 47 formed in the left end portion of the front wall 44 and the front wall 91.

In the housing 31 of the tank 103 (in the embodiment, the tanks 103C, 103M, and 103Y) mounted on the mounting portion 110A, it is only necessary that at least the front wall 91 facing the front has translucency. In addition, in the housing 31 of the tank 103 (in the embodiment, the tank 103B) mounted on the mounting portion 110B, it is only necessary that at least the front wall 91 facing the front has translucency.

In addition, it is not necessary that all the tanks 103B, 103C, 103M, and 103Y have a wall having translucency, it is preferable that at least one of the tanks 103B, 103C, 103M, and 103Y has a wall having translucency, and it is more preferable that all the tanks 103B, 103C, 103M, and 103Y has a wall having translucency.

An opening facing the right side wall 95 of the housing 117 may be formed in the right side wall 45 of the lower housing 13. In this case, since the right side wall 95 has translucency, the ink stored in the internal space 119 can be seen through the opening and the right side wall 95 when the lower housing 13 is seen from the right side. In addition, an opening facing the left side wall 96 of the housing 117 may be formed in the left side wall 46 of the lower housing 13. In this case, since the left side wall 96 has translucency, the ink stored in the internal space 119 can be seen through the opening and the left side wall 96 when the lower housing 13 is seen from the left side.

As illustrated in FIG. 4B, an air communication hole 124 that penetrates the upper wall 93 is formed in the upper wall 93 of the housing 117 of the tank 103. As a result, the internal space 119 communicates with air. In addition, the internal space 119 communicates with the ink tube 20. As a result, the ink stored in the internal space 119 is supplied to the recording head 21 through the ink tube 20.

As illustrated in FIG. 5, the tank 103 includes a passage tube 120. The passage tube 120 extends in the up-down direction and penetrates the upper wall 93. The passage tube 120 extends upward from the upper wall 93.

The passage tube 120 includes an outer peripheral wall 122 and a partition wall 123. The partition wall 123 extends up to a position above the outer peripheral wall 122. The partition wall 123 divides an internal space of the outer peripheral wall 122 into two spaces. One of the two spaces is a first flow path 125. Another one of the two spaces is a second flow path 126.

The first flow path 125 is a space surrounded by a rear portion of the outer peripheral wall 122 and the partition wall 123. An opening 125A is formed in one end of the first flow path 125, and an opening 125B is formed on another end of the first flow path 125.

The second flow path 126 is a space surrounded by a front portion of the outer peripheral wall 122 and the partition wall 123. An opening 126A is formed in one end of the second flow path 126, and an opening 126B is formed on another end of the second flow path 126.

The openings 125A and 126A are positioned in the internal space 119. The openings 125A and 126A are positioned below the air communication hole 124. The opening 126A is positioned below the opening 125A.

The openings 125B and 126B are positioned outside the tank 103. The opening 125B allows the internal space 119 to communicate with the outside of the tank 103 through the first flow path 125. The opening 126B allows the internal space 119 to communicate with the outside of the tank 103 through the second flow path 126.

[Optical Sensor 113]

As illustrated in FIGS. 2 and 5, the optical sensor 113 is disposed in the inner wall 81 of the holder 101. The optical sensor 113 includes a light emitting portion and a light receiving portion. The light emitting portion and the light receiving portion are disposed to face each other with a gap in the left-right direction.

The optical sensor 113 outputs different detection signals to a controller 1 (refer to FIG. 2) depending on whether or not light emitted from the light emitting portion along the left-right direction is received by the light receiving portion. The optical sensor 113 and the controller 1 are connected to each other through a cable 4. For example, the optical sensor 113 outputs a low level signal to the controller 1 on the condition that light emitted from the light emitting portion cannot be received by the light receiving portion (that is, the intensity of light received is lower than a predetermined intensity). On the other hand, the optical sensor 113 outputs a high level signal to the controller 1 on the condition that light emitted from the light emitting portion can be received by the light receiving portion (that is, the intensity of light received is higher than or equal to a predetermined intensity).

The controller 1 controls an operation of the multifunctional peripheral 10 and includes a CPU, a ROM, a RAM, and the like. The CPU, the ROM, the RAM, and the like are mounted on a control board 3. As illustrated in FIG. 1, the control board 3 is disposed on a right rear portion inside the lower housing 13. As illustrated in FIG. 3, the cable 4 through which the optical sensor 113 of the mounting portion 110B and the control board 3 are connected passes through a space above the conveying path 24 and in front of the recording head 21 in a direction from the mounting portion 110B to the mounting portion 110A, is routed to the right side, and is routed rearward to the control board 3 together with the cable 4 extending from the optical sensor 113 disposed corresponding to the each of the tanks 103C, 103M, and 103Y of the mounting portion 110A. The cable 4 through which the optical sensor 113 of the mounting portion 110A and the control board 3 are connected is routed rearward from the mounting portion 110*a* to the control board 3. The position where the control board 3 is disposed may be a position other than the right rear portion inside the lower housing 13. The routing of the cable 4 is appropriately determined depending on the position where the control board 3 is disposed.

[Connector 130]

As illustrated in FIGS. 2 and 5, the connector 130 is disposed in the inner wall 81 of the holder 101. The connector 130 includes four contact points 132. The four contact points 132 are disposed in parallel with a gap in the left-right direction. The contact points 132 correspond to electrodes 65 of the circuit board 64 of the ink cartridge 30, respectively. The number of contact points 132 is not limited to four.

The contact point 132 is formed of a conductive and elastic member. The contact point 132 protrudes forward from the connector 130. The contact point 132 is connected to a board (not illustrated). As a result, the contact point 132 is electrically connected to an electric circuit mounted on the board. The electric circuit is electrically connected to the controller 1 (refer to FIG. 2) through a cable 5. The cable 5 is routed using the same method as that of the cable 4 (refer to FIG. 2).

In the embodiment, the connector 130 is provided corresponding to only the tank 103B among the tanks 103B, 103C, 103M, and 103Y. That is, the connector 130 is provided corresponding to one chamber of the mounting portion 110B and is not provided in the mounting portion 110A. However, the connector 130 may be provided corresponding to at least one of the tanks 103C, 103M, and 103Y. That is, the connector 130 may be provided in at least one chamber among the three chambers of the mounting portion 110A.

[Ink Cartridge 30]

The ink cartridge 30 (an example of the reservoir) illustrated in FIG. 4A is a container that stores ink. Three ink cartridges 30 are accommodated in the three divided chambers of the internal space 108 (refer to FIG. 3) of the holder 101 of the mounting portion 110A, respectively. In addition, one ink cartridge 30 is accommodated in the internal space 108 (refer to FIG. 3) of the holder 101 of the mounting portion 110B.

As described above, the internal space 108 of the holder 101 of the mounting portion 110A is divided into three chambers arranged in the left-right direction. That is, as illustrated in FIG. 3, the three ink cartridges 30 mounted on the internal space 108 of the holder 101 of the mounting portion 110A are disposed in parallel along the left-right direction. When a plurality of ink cartridges 30 are disposed in the mounting portion 110B, the ink cartridges 30 may be disposed in parallel along the left-right direction.

The color of the ink stored in the ink cartridge 30 disposed in each of the chambers of the internal space 108 is the same as the color of the ink stored in the tank 103 disposed in each of the chambers. That is, in the embodiment, on the three chambers of the internal space 108 of the holder 101 of the mounting portion 110A, the ink cartridge 30 that stores cyan ink (hereinafter, referred to as "ink cartridge 30C"), the ink cartridge 30 that stores magenta ink (hereinafter, referred to as "ink cartridge 30M"), and the ink cartridge 30 that stores yellow ink (hereinafter, referred to as "ink cartridge 30Y") are mounted in order from the left chamber. On one chamber of the internal space 108 of the holder 101 of the mounting portion 110B, the ink cartridge 30 that stores black ink (hereinafter, referred to as "ink cartridge 30B") is mounted. That is, the ink cartridge 30C is connected to the tank 103C, the ink cartridge 30M is connected to the tank 103M, the ink cartridge 30Y is connected to the tank 103Y, and the ink cartridge 30B is connected to the tank 103B. Hereinafter, the ink cartridges 30C, 30M, 30Y, and 30B will also be collectively referred to as "ink cartridge 30".

The number of ink cartridges 30 disposed in the internal space 108 and the color or material of the ink stored in the ink cartridge 30 disposed in each of the chambers are determined depending on the configuration of the mounting portion 110 (the number of chambers in the internal space 108 of the holder 101 of the mounting portion 110 and the color or material of the ink stored in each of the tank 103).

The ink cartridges 30C, 30M, 30Y, and 30B have substantially the same configuration, except that the ink cartridge 30B is larger than the ink cartridges 30C, 30M, and 30Y. Therefore, hereinbelow, the configuration of the ink cartridge 30B will be described. The configuration of the ink cartridges 30C, 30M, and 30Y will not be described in principle and will be optionally described. Hereinbelow, the configuration of the ink cartridge 30B will be described. For convenience of description, the ink cartridge 30B will be described as the ink cartridge 30.

As illustrated in FIGS. 4A and 5, the ink cartridge 30 includes a housing 31, a protrusion 67, and a circuit board 64. In the following description of the configuration of the ink cartridge 30, unless specified otherwise, assuming that the ink cartridge 30 is in a stand posture (in a posture where the ink cartridge 30 is connected to the tank 103; a posture illustrated in FIG. 5), the front-rear direction, the up-down direction, and the left-right direction are defined.

As illustrated in FIG. 4A, the housing 31 has a substantially rectangular shape. The housing 31 has an overall shape in which the dimension in the left-right direction is less than the dimension in the front-rear direction and the dimension in each of the up-down direction and the front-rear direction is more than the dimension in the left-right direction.

The housing 31 includes a front wall 40, a rear wall 41, an upper wall 39, a lower wall 42, a right side wall 37, and a left side wall 38. The front wall 40 and the rear wall 41 are separated from each other in the front-rear direction. The upper wall 39 is positioned between the front wall 40 and the rear wall 41 and extends from an upper end of the front wall 40 to an upper end of the rear wall 41. The lower wall 42 is positioned between the front wall 40 and the rear wall 41 and extends from a lower end of the front wall 40 to a lower end of the rear wall 41. The upper wall 39 and the lower wall 42 connect the front wall 40 and the rear wall 41 to each other. The right side wall 37 is positioned between the front wall 40 and the rear wall 41 and extends from a right end of the front wall 40 to a right end of the rear wall 41. The left side wall 38 is positioned between the front wall 40 and the rear wall 41 and extends from a left end of the front wall 40 to a left end of the rear wall 41. The right side wall 37 and the left side wall 38 connect the front wall 40 and the rear wall 41 to each other. The upper wall 39 and the lower wall 42 are separated from each other in the up-down direction. The right side wall 37 and the left side wall 38 are separated from each other in the left-right direction. The periphery of the right side wall 37 and the left side wall 38 are connected to the front wall 40, the rear wall 41, the upper wall 39, and the lower wall 42.

As illustrated in FIG. 5, the housing 31 includes an internal space 151. The internal space 151 is formed with the front wall 40, the rear wall 41, the upper wall 39, the lower wall 42, the right side wall 37, and the left side wall 38. In the internal space 151, ink can be stored.

As illustrated in FIG. 2, in a state where the sub-cover 18 is positioned at the opened position, the housing 31 is inserted into and mounted downward on the holder 101 through the opening 112 and is removed upward from the holder 101.

The housing 31 has translucency such that the ink stored in the internal space 151 can be seen from the outside.

As illustrated in FIG. 1, in the mounted state, the front wall 40 of the housing 31 faces the opening 47 in the front-rear direction, the opening 47 being formed in the front wall 44 of the lower housing 13. As a result, when the lower housing 13 is seen from the front, the front wall 40 can be seen through the opening 47. In addition, the front wall 40 has translucency. Therefore, when the lower housing 13 is seen from the front, the ink stored in the internal space 151 can be seen through the opening 47 and the front wall 40. In the embodiment, the inks stored in the ink cartridges 30C, 30M, and 30Y can be seen through the opening 47 formed in the right end portion of the front wall 44 and the front wall 40, and the ink stored in the ink cartridge 30B can be seen through the opening 47 formed in the left end portion of the front wall 44 and the front wall 40.

In the housing 31 of the ink cartridge 30 (in the embodiment, the ink cartridges 30C, 30M, and 30Y) mounted on the mounting portion 110A, it is only necessary that at least the front wall 40 facing the front has translucency. In addition, in the housing 31 of the ink cartridge 30 (in the embodiment, the ink cartridge 30B) mounted on the mounting portion 110B, it is only necessary that at least the front wall 40 facing the front has translucency.

An opening facing the right side wall 37 of the housing 31 may be formed in the right side wall 45 of the lower housing 13. In this case, since the right side wall 37 has translucency, the ink stored in the internal space 151 can be seen through the opening and the right side wall 37 when the lower housing 13 is seen from the right side. In addition, an opening facing the left side wall 38 of the housing 31 may be formed in the left side wall 46 of the lower housing 13. In this case, since the left side wall 38 has translucency, the ink stored in the internal space 151 can be seen through the opening and the left side wall 38 when the lower housing 13 is seen from the left side.

In addition, it is not necessary that all the ink cartridges 30B, 30C, 30M, and 30Y have a wall having translucency, it is preferable that at least one of the ink cartridges 30B, 30C, 30M, and 30Y has a wall having translucency, and it is more preferable that all the ink cartridges 30B, 30C, 30M, and 30Y has a wall having translucency.

As illustrated in FIG. 4A, a through hole 152 is formed in the lower wall 42 of the housing 31. The internal space 151 communicates with the outside through the through hole 152. The ink stored in the internal space 151 can be caused to flow to the outside through the through hole 152. In the embodiment, the through hole 152 is blocked with a seal 153 bonded to an outer surface of the lower wall 42. Therefore, the flow of the ink stored in the internal space 151 to the outside is restricted.

A method of blocking the through hole 152 is not limited to the seal 153. For example, a so-called duckbill valve may be attached to the through hole 152. In addition, for example, the through hole 152 may be closed when a movable valve disposed in the internal space 151 is biased by a coil spring, and may be opened when the valve is pressed against the passage tube 120 and moves.

As illustrated in FIG. 3, when the ink cartridge 30 is mounted on the mounting portion 110 (in other words, when the ink cartridge 30 is connected to the tank 103), the ink cartridge 30 is in front of a center position P1 of the lower housing 13 in the front-rear direction. That is, the ink cartridge 30 is positioned to be closer to the front side wall 162 than the center position P1.

As illustrated in FIG. 5, when the ink cartridge 30 is mounted on the mounting portion 110, an upper end portion of the ink cartridge 30 protrudes upward from the lower housing 13. As a result, when the cover 14 is positioned at the covering position, the upper end portion of the ink cartridge 30 is present in the internal space 166 of the cover 14. That is, when the cover 14 is positioned at the covering position, the upper end of the ink cartridge 30 (in the embodiment, an upper surface of the upper wall 39) is positioned above a lower end 162A of the front side wall 162. In addition, as illustrated in FIG. 5, when the ink cartridge 30 is mounted on the mounting portion 110, the liquid level of the ink stored in the ink cartridge 30 is higher than the lower end 162A of the front side wall 162. Of course, when the ink stored in the ink cartridge 30 is consumed, the liquid level of the ink stored in the ink cartridge 30 may be lower than the lower end 162A of the front side wall 162.

Here, as described above, when the cover 14 is positioned at the covering position and the multifunctional peripheral 10 is seen from above, the scanner housing 167 does not overlap a mounting portion 110 described below. Therefore, the upper end portion of the ink cartridge 30 present in the internal space 166 does not interfere with the scanner housing 167.

[Protrusion 67]

As illustrated in FIGS. 4A and 5, the protrusion 67 that protrudes rearward is provided in the rear wall 41 of the housing 31. The protrusion 67 extends in the up-down direction.

A right surface or a left surface of the protrusion 67 is a surface to which the optical sensor 113 of the mounting portion 110 emits light. In the embodiment, the protrusion 67 is a resin plate including, for example, a color material (black pigment) capable of blocking or attenuating light. In another aspect, a material such as aluminum foil that does not allow transmission of light may be bonded to at least a light blocking surface of the protrusion 67.

[Circuit Board 64]

As illustrated in FIGS. 4A and 5, the circuit board 64 is attached to the rear wall 41 of the housing 31. The circuit board 64 is positioned below the protrusion 67. The position of the circuit board 64 is not necessarily positioned below the protrusion 67. The circuit board 64 includes a board 63, a memory (not illustrated), and an electrode 65.

In the embodiment, the circuit board 64 is provided in only the ink cartridge 30B among the ink cartridges 30B, 30C, 30M, and 30Y. That is, the circuit board 64 is not provided in the ink cartridges 30C, 30M, and 30Y. However, the circuit board 64 may be provided in at least one of the ink cartridges 30C, 30M, and 30Y.

In the circuit board 64, the memory is mounted on the board 63 that is a rigid board formed of glass epoxy or the like, and the four electrodes 65 are formed. The number of electrodes 65 is determined depending on the number of contact points 132 in the mounting portion 110 and is not limited to four.

The memory is mounted on a back surface (a surface facing the rear wall 41) of the board 63. In the embodiment, when the board 63 is attached to the rear wall 41, a recessed portion (not illustrated) capable of accommodating the memory is formed at a position of the rear wall 41 corresponding to the memory. The mounting position of the memory is not limited to the back surface of the board 63.

Information regarding the ink cartridge 30 is stored in the memory such that the information can be read by the controller 1 (refer to FIG. 2) of the multifunctional peripheral 10. The information regarding the ink cartridge 30 is, for example, data representing information such as a lot number, a manufacturing date, or an ink color. In addition, for example, information regarding the amount of ink stored in the ink cartridge 30 such as the consumption of ink may be stored. The memory is a semiconductor memory, for example, a nonvolatile memory such as FRAM (registered trade name) or a volatile memory such as SRAM.

The four electrodes 65 corresponds to the four contact points 132 of the mounting portion 110, respectively. As illustrated in FIG. 4A, the four electrodes 65 are exposed to allow electrical connection. Each of the electrodes 65 extends long the up-down direction. The electrodes 65 are arranged to be separated from each other in the left-right direction. Each of the electrodes 65 is electrically connected to the memory.

[Operation of Mounting Ink Cartridge 30 on Mounting Portion 110]

Hereinafter, the operation of mounting the ink cartridge 30 on the holder 101 of the mounting portion 110 will be described.

As illustrated in FIG. 4A, in the ink cartridge 30 that is not mounted on the mounting portion 110, the through hole 152 is not sealed with the seal 153. Therefore, the ink stored in the internal space 151 is prevented from flowing out to the outside.

In addition, in the mounting portion 110 on which the ink cartridge 30 is not mounted, another member is not provided between the light emitting portion and the light receiving portion of the optical sensor 113. As a result, light can propagate from the light emitting portion to the light receiving portion. At this time, the optical sensor 113 outputs a high level detection signal to the controller 1 (refer to FIG. 2). When a high level detection signal is received from the optical sensor 113, the controller 1 determines that the ink cartridge 30 is not mounted on the mounting portion 110.

First, the cover 14 (refer to FIG. 1) is rotated from the covering position to the opened position. As a result, the upper end of the lower housing 13 is opened, and the sub-cover 18 is exposed. Next, the sub-cover 18 is rotated from the covering position to the opened position. As a result, the opening 112 is exposed.

The ink cartridge 30 is inserted from above holder 101 into the internal space 108 of the holder 101 through the opening 112. In the embodiment, the ink cartridge 30 is inserted downward into the holder 101, but the embodiment is not limited thereto. The ink cartridge 30 may be inserted into the holder 101 in a direction inclined with respect to the up-down direction (downwardly inclined direction).

As illustrated in FIG. 5, when the ink cartridge 30 is inserted into the holder 101, the passage tube 120 breaks through the seal 153 from below the ink cartridge 30, penetrates the through hole 152, and enters the internal space 151 of the ink cartridge 30. That is, the passage tube 120 is connected to the through hole 152. As a result, the ink stored in the internal space 151 can be caused to flow to the internal space 119 of the tank 103 through the passage tube 120.

A ring member (not illustrated) formed of an elastic body such as rubber is attached to the periphery of the through hole 152. The ring member adheres liquid-tightly to an outer peripheral surface of the passage tube 120 having penetrated the through hole 152.

In addition, when the ink cartridge 30 is inserted into the holder 101, the protrusion 67 is positioned between the light emitting portion and the light receiving portion of the optical sensor 113. As a result, the protrusion 67 blocks light from propagating from the light emitting portion to the light receiving portion. At this time, the optical sensor 113 outputs a low level detection signal to the controller 1 (refer to FIG. 2). When a low level detection signal is received from the optical sensor 113, the controller 1 determines that the ink cartridge 30 is mounted on the mounting portion 110.

In addition, when the ink cartridge 30 is inserted into the holder 101, the electrodes 65 of the circuit board 64 come into contact with the corresponding contact points 132 from the front, respectively. When the electrodes 65 come into contact with the corresponding contact points 132, respectively, for electrical connection, a voltage Vc is applied to the electrode 65, the electrode 65 is grounded, or power is supplied to the electrode 65. In addition, due to the electrical connection between the contact points 132 and the electrodes 65, the memory mounted on the circuit board 64 is electrically connected to the controller 1 (refer to FIG. 2). As a result, the controller 1 is accessible to the memory. As a result, data stored in the memory is input to the controller 1.

When the ink cartridge 30 is removed from the holder 101, the cover 14 is rotated from the covering position to the opened position. Next, the user holds the ink cartridge 30 and pulls up the ink cartridge 30. As a result, the passage tube 120 is removed from the through hole 152, and the ink cartridge 30 is removed from the holder 101. Next, the sub-cover 18 is rotated from the opened position to the covering position, and the cover 14 is rotated from the opened position to the covering position.

Hereinafter, in the mounted state illustrated in FIG. 5, the supply of ink from the ink cartridge 30 to the tank 103 will be described. In the embodiment, the supply of ink from the ink cartridge 30 to the tank 103 is performed using a so-called chicken feed method described below in detail.

When the ink cartridge 30 is connected to the tank 103 and the openings 125B and 126B of the passage tube 120 are positioned in the internal space 151 of the ink cartridge 30, the internal space 151 and the internal space 119 of the tank 103 communicate with each other through the first flow path 125 and the second flow path 126. As a result, as indicated by a chain line arrow in FIG. 5, the ink stored in the internal space 151 flows to the second flow path 126 through the opening 126B and flows from the opening 126A of the second flow path 126 to the internal space 119. In addition, when the ink flows, as indicated by a broken line arrow in FIG. 5, air enters from the air communication hole 124 into the internal space 119 and flows from the first flow path 125 to the internal space 151 through the opening 125B. Here, the volume of the ink flowing from the ink cartridge 30 to the tank 103 and the volume of the air flowing from the tank 103 to the ink cartridge 30 are substantially the same. This way, so-called gas-liquid displacement is performed.

When the ink flows to the internal space 119 such that the liquid level of the ink in the internal space 119 increases and reaches the opening 125A of the first flow path 125, the flow of air between the first flow path 125 and the internal space 151 is blocked. As a result, the flow of air from the internal space 119 to the internal space 151 is stopped. Therefore, the flow of the ink from the internal space 151 to the internal space 119 is stopped.

Effects of Embodiment

In the embodiment, the ink cartridge 30 extends up to a position above the lower end of the front side wall 162 of the cover 14. That is, in the ink cartridge 30 according to the embodiment, the length in the up-down direction can be set to be longer than that of the ink cartridge 30 that extends only up to a position below the lower end of the front side wall 162 of the cover 14. As a result, the volume of the ink cartridge 30 can be increased without increasing the installation area of the lower housing 13.

In the embodiment, when the cover 14 is moved to the opened position, the front side wall 162 close to the ink cartridge 30 is separated from the ink cartridge 30. Therefore, the ink cartridge 30 can be easily taken out.

When the ink cartridge 30 extends up to a position above the lower housing 13, the upper portion of the ink cartridge 30 may be damaged by impact from above. In the embodiment, due to the cover 14, the possibility of the above-described damage can be reduced.

In the embodiment, a space of the cover 14 that is not occupied by the scanner 12 can be occupied by the upper portion of the ink cartridge 30.

In the embodiment, in a case where the tanks 103 and the ink cartridges 30 are disposed in left and right regions of the conveying path 24 in the lower housing 13, when the tanks 103 and the ink cartridges 30 are disposed to be distributed to both left and right sides of the conveying path 24, the size of each of the tanks 103 in the left-right direction can be more easily increased without increasing the size of the lower housing 13 in the left-right direction as compared to a case where all of the tanks 103 and the ink cartridges 30 are disposed on one of left and right sides of the conveying path 24.

In the embodiment, in a state where the ink cartridge 30 is connected to the tank 103, when the ink stored in the tank 103 is consumed such that the liquid level of the ink becomes lower than the opening 125A as the lower end of the first flow path 125, air enters from the air communication hole 124 into the tank 103 and then enters into the ink cartridge 30 through the first flow path 125. The ink corresponding to the volume of the air entering into the ink cartridge 30 is supplied from the ink cartridge 30 into the tank 103 through the second flow path 126. When the liquid level of the ink in the tank 103 reaches the opening 125A of the first flow path 125, the supply of the ink is stopped. As a result, the liquid level of the ink stored in the tank 103 can be maintained to be constant.

Modification Example

In the embodiment, the lengths of the front side wall 162, the rear side wall 163, the right side wall 164, and the left side wall 165 in the up-down direction are the same. However, the lengths may be different from each other.

Figure 7:
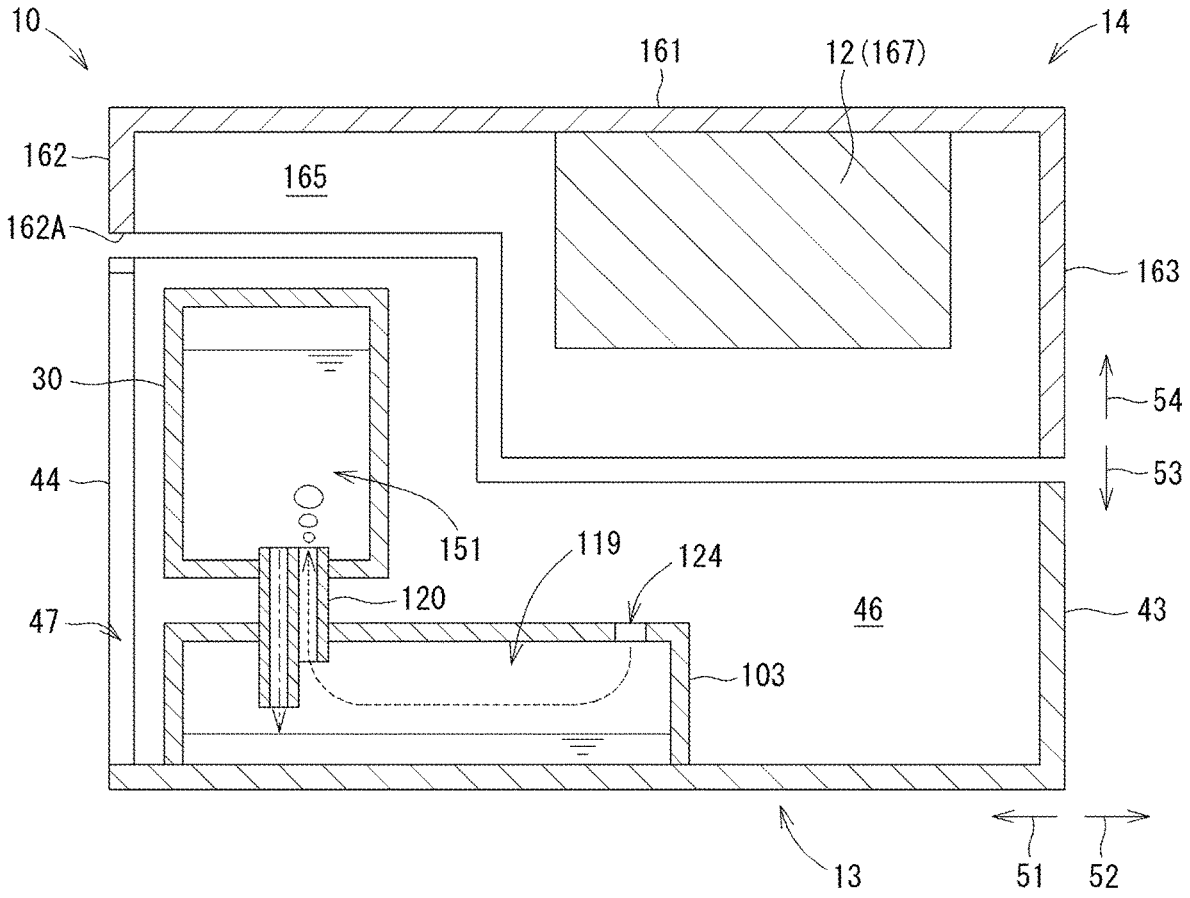
FIG. 7 is a longitudinal sectional view illustrating the multifunctional peripheral 10 in a modification example.
Figure 13:
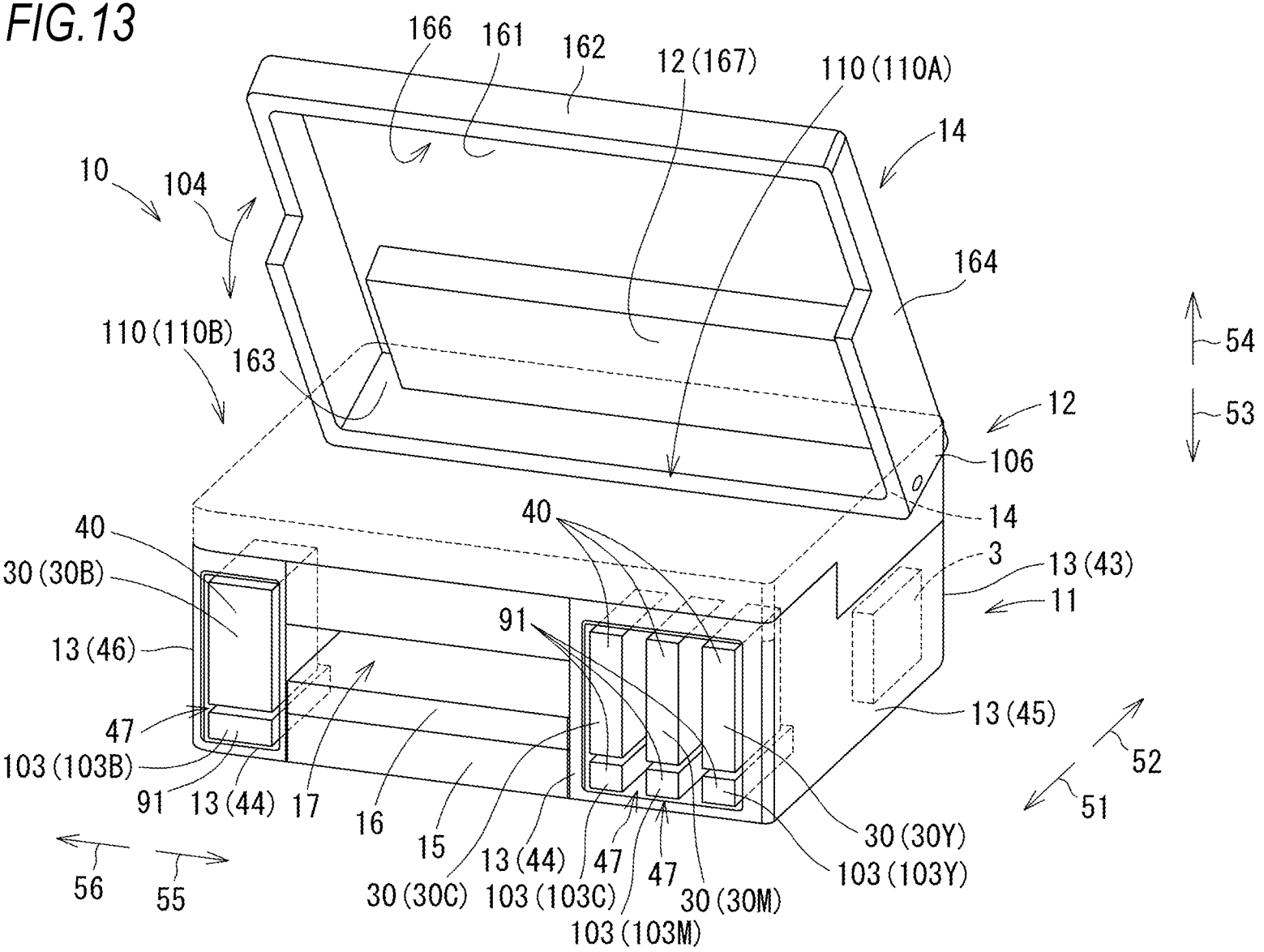
FIG. 13 is a perspective view illustrating the multifunctional peripheral 10 in a modification example.

For example, as illustrated in FIGS. 7 and 13, in the cover 14, the rear side wall 163 may extend downward to be longer than the front side wall 162. In the configuration illustrated in FIG. 7, the rear side wall 163 corresponds to the second wall, and the front side wall 162 corresponds to the third wall.

In the configuration illustrated in FIGS. 7 and 13, when the cover 14 is positioned at the covering position and the ink cartridge 30 is connected to the tank 103, the lower end 162A of the front side wall 162 is positioned above the upper end of the ink cartridge 30.

Even in the configuration illustrated in FIGS. 7 and 13, as in the embodiment, the opening 47 is formed in the right end portion and the left end portion of the front wall 44. The opening 47 faces the ink cartridge 30 connected to the tank 103 in the front-rear direction. An upper end 47A of the opening 47 is positioned above the ink cartridge 30 connected to the tank 103.

In the configuration illustrated in FIGS. 7 and 13, the lower end of the front side wall 162 is positioned above the upper end of the ink cartridge 30. Therefore, the front wall 44 of the lower housing 13 can be made to extend upward from the upper end of the ink cartridge 30. As a result, direct influence of impact from the front to the lower housing 13 on the ink cartridge 30 can be restricted by the front wall 44.

When the cover 14 is positioned at the covering position and the ink cartridge 30 is connected to the tank 103, a case where the front side wall 162 extends up to a position below the upper end of the ink cartridge 30 is assumed. In this case, although the front wall 44 includes the opening 47, the upper portion of the ink cartridge 30 (the portion of the ink cartridge 30 facing the front side wall 162 in the front-rear direction) cannot be seen through the opening 47 due to interference of the front side wall 162 when the cover 14 is positioned at the covering position. However, in the configuration illustrated in FIGS. 7 and 13, when the cover 14 is positioned at the covering position and the ink cartridge 30 is connected to the tank 103, the lower end of the front side wall 162 is positioned above the upper end of the ink cartridge 30. Therefore, as illustrated in FIGS. 7 and 13, the opening 47 can also be provided at a position where the upper portion of the ink cartridge 30 can be seen.

Figure 6:
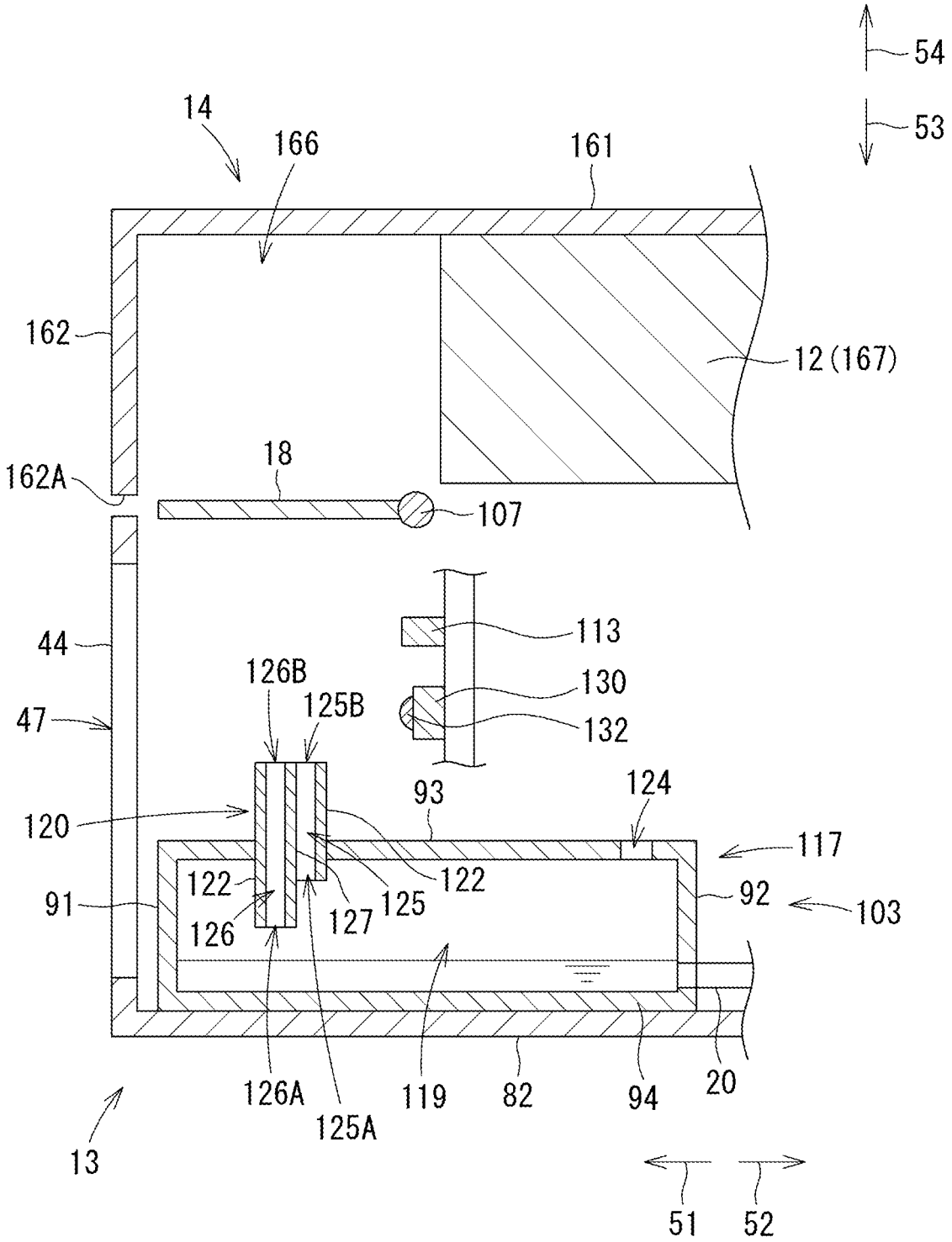
FIG. 6 is a longitudinal sectional view illustrating the periphery of the tank 103 in a state where the ink cartridge 30 is not mounted.
Figure 8:
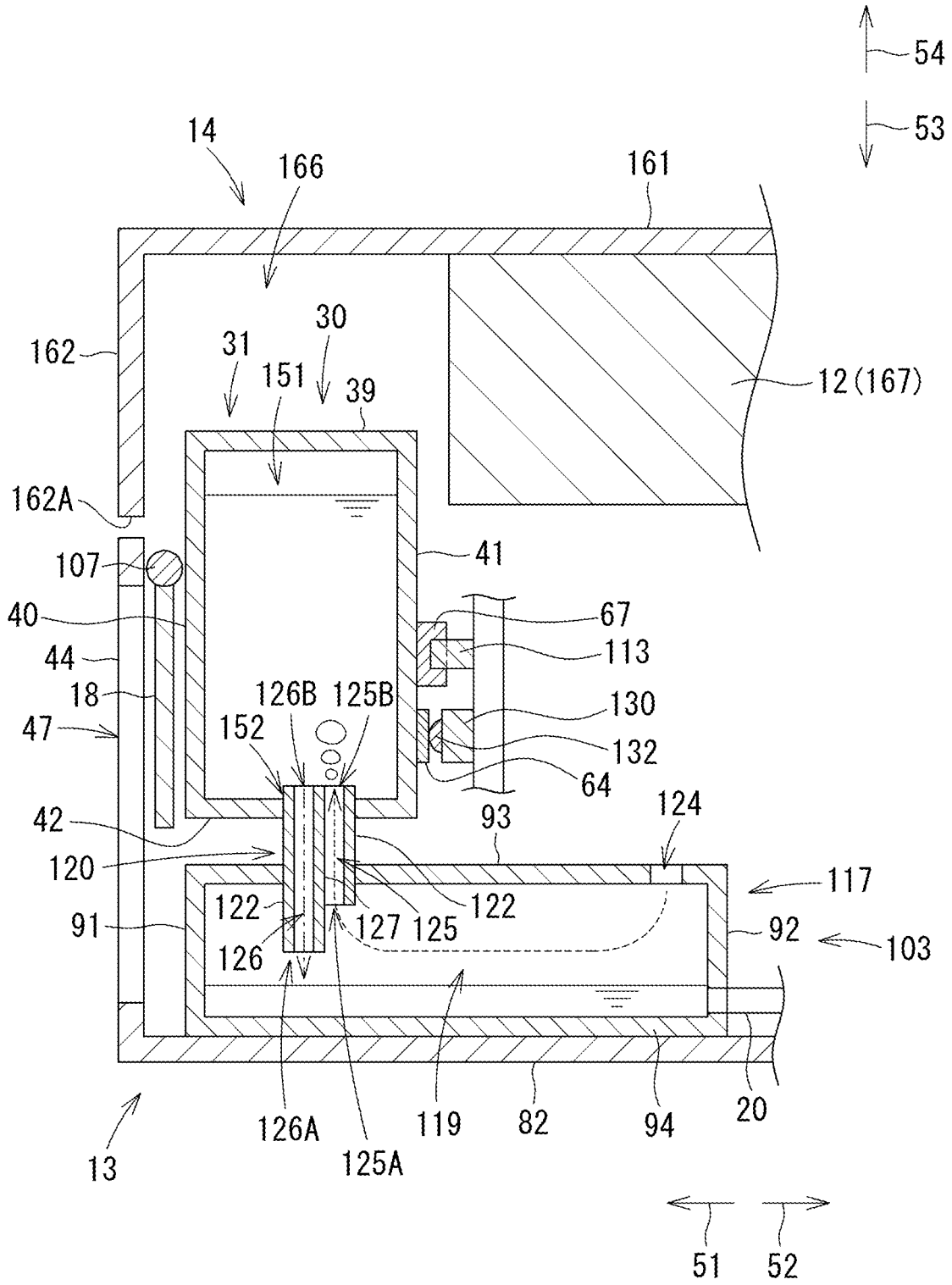
FIG. 8 is a longitudinal sectional view illustrating the periphery of the tank 103 in a mounted state in a modification example.
Figure 9:
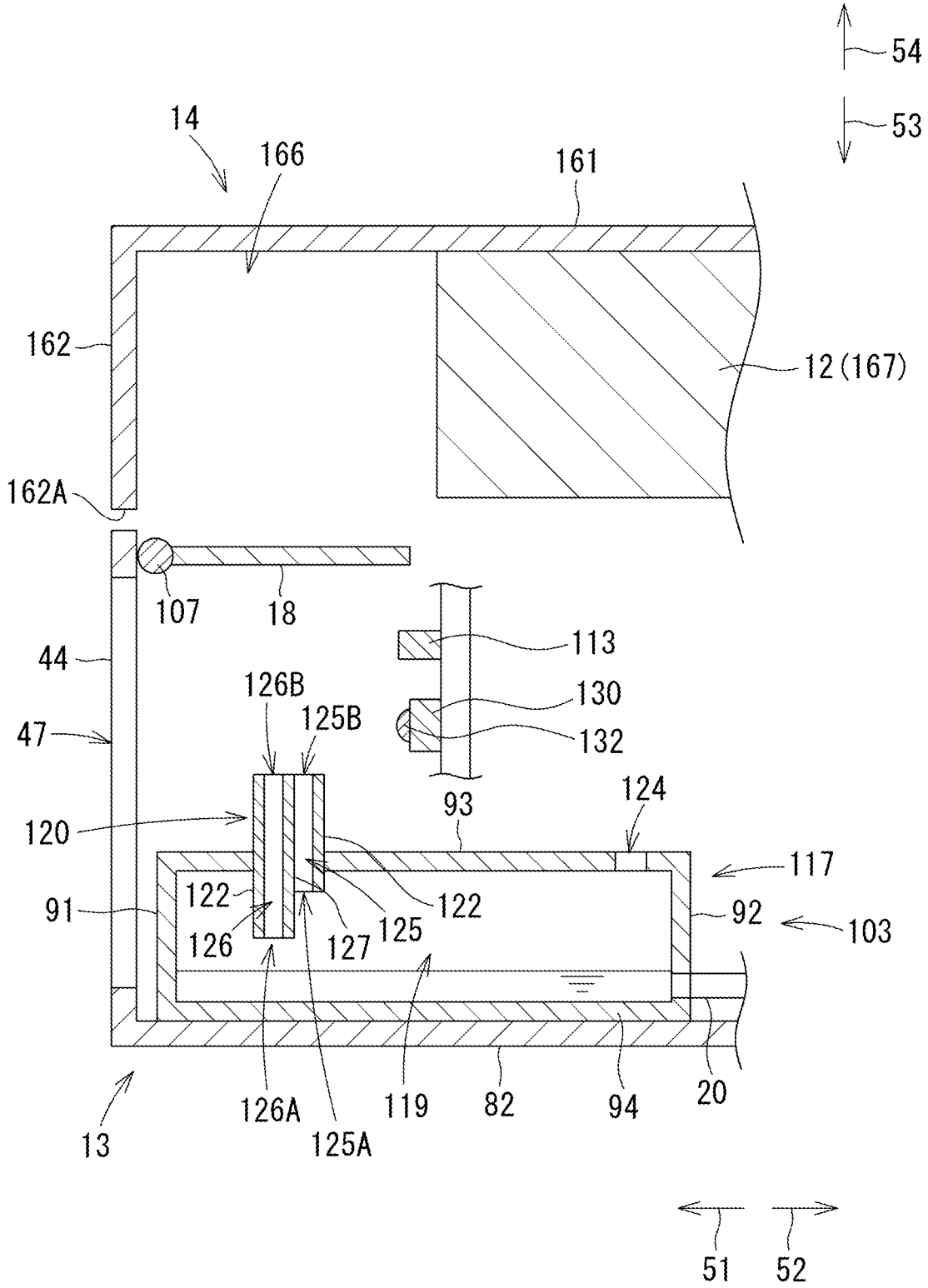
FIG. 9 is a longitudinal sectional view illustrating the periphery of the tank 103 in a state where the ink cartridge 30 is not mounted in a modification example.

In the embodiment, as illustrated in FIGS. 5 and 6, the sub-cover 18 (refer to FIG. 5) at the opened position is positioned above the sub-cover 18 (refer to FIG. 6) at the covering position. However, contrary to the embodiment, as illustrated in FIGS. 8 and 9, the sub-cover 18 (refer to FIG. 8) at the opened position may be positioned below the sub-cover 18 (refer to FIG. 9) at the covering position. In this case, it is preferable to provide a biasing member (not illustrated) such as a coil spring that biases the sub-cover 18 to the covering position.

Figure 10:
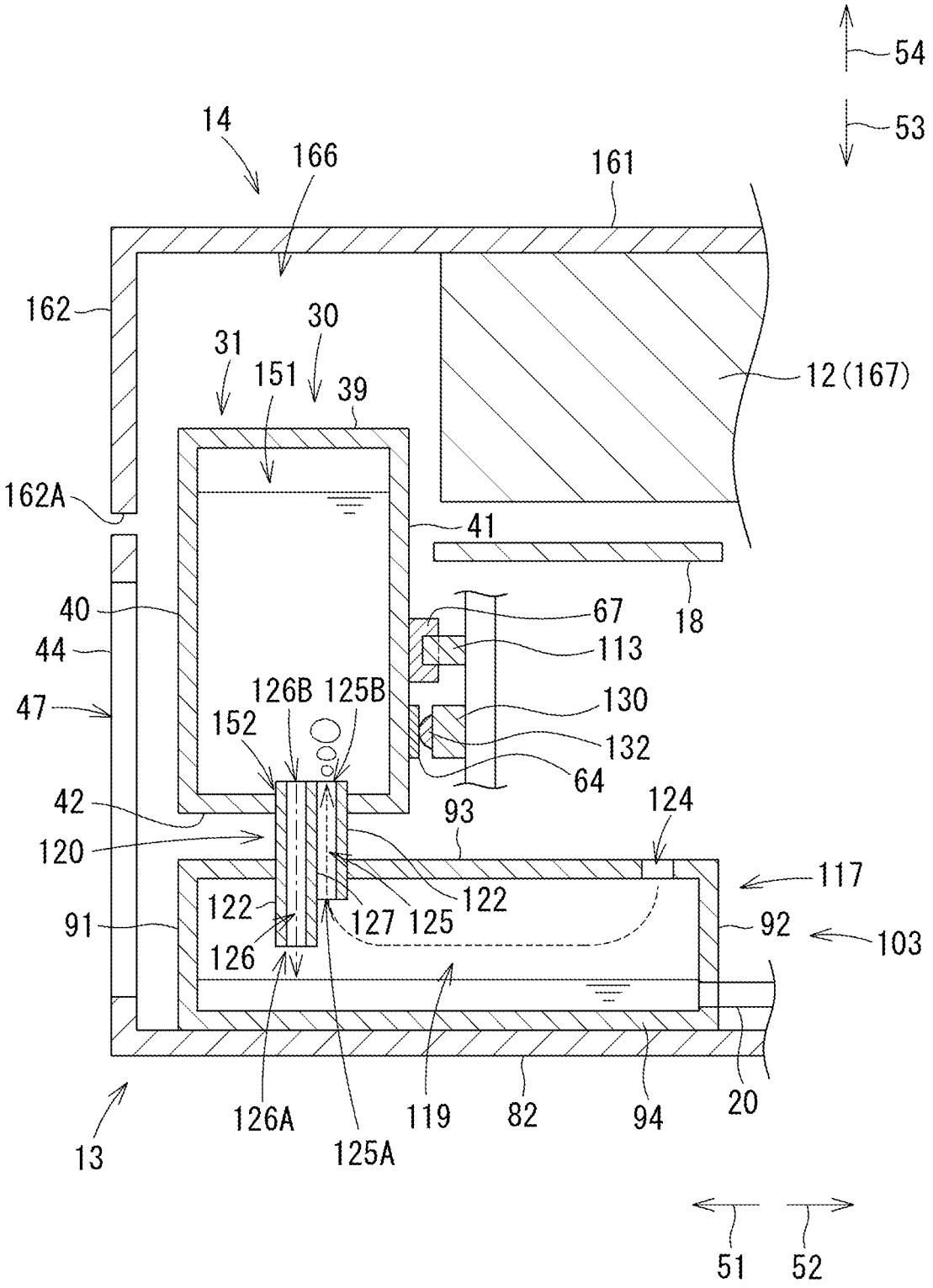
FIG. 10 is a longitudinal sectional view illustrating the periphery of the tank 103 in a mounted state in a modification example.
Figure 11:
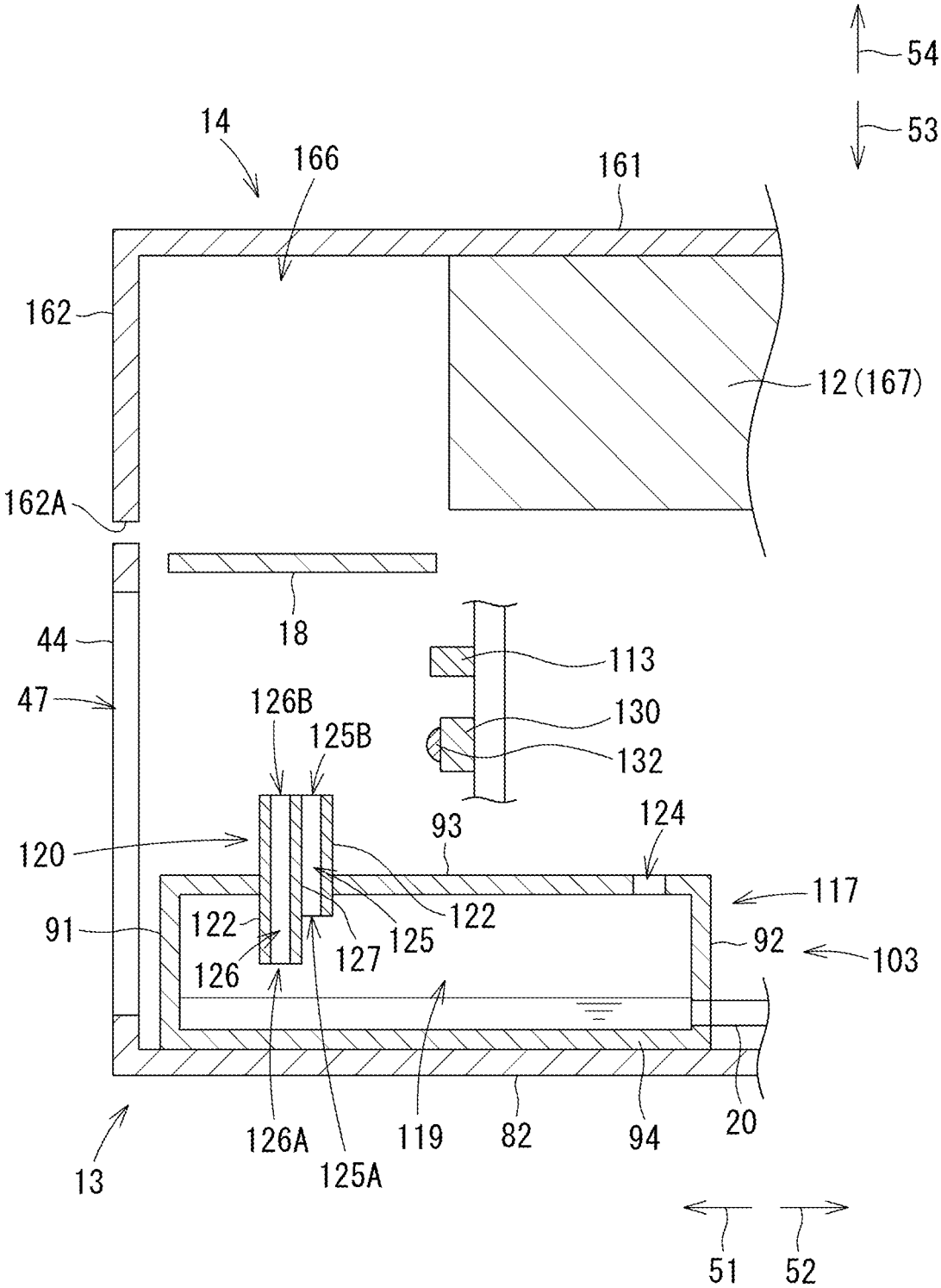
FIG. 11 is a longitudinal sectional view illustrating the periphery of the tank 103 in a state where the ink cartridge 30 is not mounted in a modification example.

In the embodiment, as illustrated in FIGS. 5 and 6, the sub-cover 18 is moved to the opened position and the covering position by rotation. However, a method of moving the sub-cover 18 is not limited to rotation. For example, as illustrated in FIGS. 10 and 11, the sub-cover 18 may be supported by the lower housing 13 to be slidable in the front-rear direction. In this case, the sub-cover 18 is moved to the opened position illustrated in FIG. 10 and the covering position illustrated in FIG. 11 by sliding in the front-rear direction.

In the embodiment, the supply of the ink from the ink cartridge 30 to the tank 103 is performed using a chicken feed method but may be performed using a method other than a chicken feed method. For example, the supply of the ink from the ink cartridge 30 to the tank 103 may be performed using a water head difference between the liquid level of the ink stored in the internal space 151 of the ink cartridge 30 and the liquid level of the ink stored in the internal space 119 of the tank 103. In this case, an air opening hole through which the internal space 151 communicates with the outside to be opened to air is formed in the housing 31 of the ink cartridge 30.

In the embodiment, the ink stored in the ink cartridge 30 and the tank 103 can be seen through the opening 47 that is an example of the light transmitting plate formed in the lower housing 13. However, a method of allowing the ink stored in the ink cartridge 30 and the tank 103 to be seen is not limited to the opening 47 as long as it has translucency. For example, a transparent plate may be bonded to the opening 47. In this case, since the plate has translucency, the ink stored in the ink cartridge 30 and the tank 103 can be seen through the plate. The plate provided in the front wall 44 is an example of the light transmitting plate.

In the embodiment, the cover 14 is moved to the covering position and the opened position by rotation but may be moved to the covering position and the opened position with a method other than rotation (for example, sliding in the front-rear direction).

In the embodiment, the ink cartridge 30 including the circuit board 64 or the protrusion 67 is connected to the tank 103. However, the reservoir that is connected to the tank 103 is not limited to the ink cartridge 30. For example, as the reservoir, a bottle not including the circuit board 64 or the protrusion 67 may be connected to the tank 103. In this case, a method of allowing the ink stored in the bottle to flow to the tank 103 may be the method using a chicken feed method or the method using a water head difference described above, or another method (a method of allowing the ink stored in the bottle to flow to the tank 103 by pumping the bottle).

The shape of the reservoir may be a rectangular shape as in the ink cartridge 30 or may be another shape. The above-described bottle may have a cylindrical shape. In addition, similarly, the shape of the tank 103 is not limited to a rectangular shape.

Figure 12:
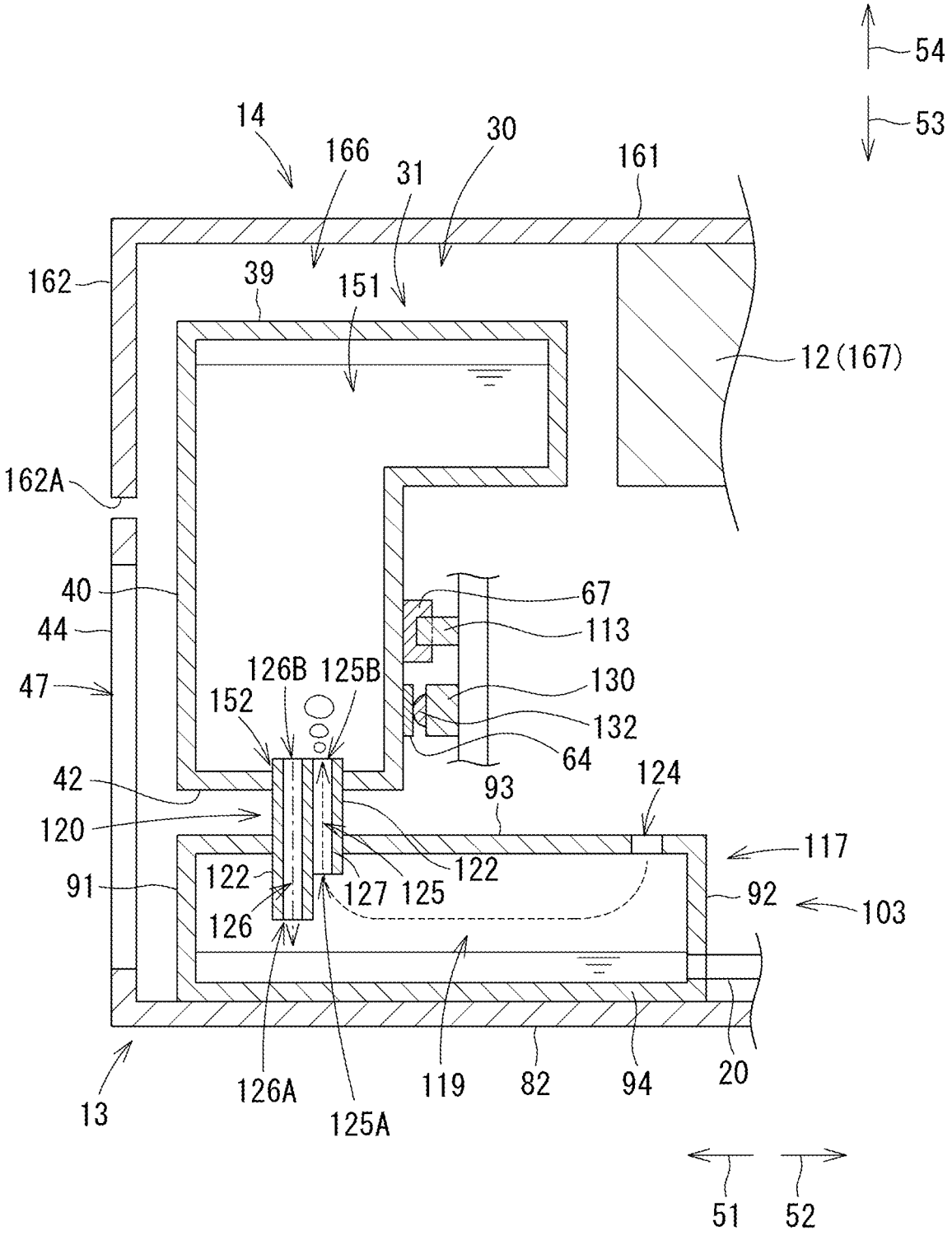
FIG. 12 is a longitudinal sectional view illustrating the periphery of the tank 103 in a mounted state in a modification example.

For example, as illustrated in FIG. 12, when the internal space 166 of the cover 14 that is not occupied by the scanner housing 167 above the internal space 108 of the mounting portion 110 spreads more than the internal space 108, a portion of the ink cartridge 30 positioned in the internal space 166 may be configured to be larger than a portion of the ink cartridge 30 positioned in the internal space 108.

In the embodiment, the mounting portion 110 includes: the mounting portion 110A that is disposed on the right of the conveying path 24 in the lower housing 13; and the mounting portion 110B that is disposed on the left of the conveying path 24 in the lower housing 13. However, the mounting portion 110 may be disposed on the right or the left of the conveying path 24 in the lower housing 13.

In the description of the embodiment, ink is an example of the liquid. However, instead of ink, for example, a pre-treatment solution that is discharged to a sheet or the like prior to ink during printing may be stored in a liquid cartridge. In addition, water for cleaning the recording head 21 may be stored in a liquid cartridge.

What is claimed is:

1. A system comprising:

a housing;

a cover that is supported by the housing to be movable between a covering position, where an upper end of the housing is covered, and an opened position, where the upper end of the housing is opened;

a tank that is disposed inside the housing and is configured to store liquid;

a reservoir that is connectable to the tank and is configured to store liquid; and a liquid discharging head that is disposed inside the housing and configured to discharge liquid supplied from the tank, wherein the reservoir includes a liquid passage hole through which the stored liquid is flowable to an outside of the reservoir, the tank includes a passage tube that extends upward from the tank and is connectable to the liquid passage hole of the reservoir, the passage tube includes a first flow path having an upper end that is opened to an inside of the tank and having a lower end that is opened to an outside of the tank through the passage tube and a second flow path having an upper end that is opened to the inside of the tank and having a lower end that is opened to the outside of the tank through the passage tube;

the cover includes:

a first wall that is positioned above the housing at the covering position; and a second wall that extends downward from an edge of the first wall and facing a front side in a front-rear direction intersecting a height direction, and when the cover is positioned at the covering position and the reservoir is connected to the tank, both of the upper ends of the first flow path and the second flow path of the passage tube are positioned below a lower end of the second wall.

2. The system according to claim 1, the reservoir connected to the tank is closer to the second wall than a center of the housing in the front-rear direction.

3. The system according to claim 1, wherein the second wall is a wall that is positioned on a rear side in a front-rear direction intersecting a height direction further than the reservoir connected to the tank and faces a rear side, the cover includes a third wall that extends downward from the edge of the first wall, is positioned on a front side in the front-rear direction further than the reservoir connected to the tank, and faces a front side, and when the cover is positioned at the covering position and the reservoir is connected to the tank, a lower end of the third wall is positioned above the upper end of the reservoir.

4. The system according to claim 3, wherein the housing includes a front wall that is positioned on the front side in the front-rear direction further than the reservoir connected to the tank and is positioned below the third wall of the cover at the covering position, the front wall includes a light transmitting plate having translucency such that the reservoir in the housing is to be visible, and the light transmitting plate faces the reservoir connected to the tank in the front-rear direction.

5. The system according to claim 1, further comprising a sub-cover that is supported by the housing to be rotatable such that an upper end of the tank is covered and opened, wherein the cover at the covering position covers the sub-cover from above.

6. The system according to claim 1, further comprising a sub-cover that is supported by the housing to be slidable such that an upper end of the tank is covered and opened, wherein the cover at the covering position covers the sub-cover from above.

7. The system according to claim 1, wherein the cover includes a scanner that reads an image recorded on a sheet.

8. The system according to claim 1, wherein the housing includes a conveying path that extends to pass a sheet in a front-rear direction intersecting a height direction, the system comprises a plurality of tanks and a plurality of reservoirs, and the tanks and the reservoirs are disposed to one side and another side with respect to the conveying path in a width direction perpendicular to the height direction and the front-rear direction.

9. The system according to claim 1, wherein the first flow path is arranged frontward of the second flow path in the front-rear direction.

10. The system according to claim 1, wherein the reservoir includes a movable valve disposed in the internal space of the through hole and spring being configured to bias the movable valve, and the valve is configured to be opened when the valve is pressed against the passage tube.

* * * * *